US005613846A

United States Patent [19]

Sommer

[11] Patent Number: 5,613,846

[45] Date of Patent: Mar. 25, 1997

[54] FILLING, FLUID-TRANSPORTING, AND PUMPING DEVICE

[76] Inventor: Manfred Sommer, Forststrasse 30, D-74199, Untergruppenbach Vorhof, Germany

[21] Appl. No.: 343,486

[22] PCT Filed: Mar. 24, 1994

[86] PCT No.: PCT/EP94/00946

§ 371 Date: Nov. 25, 1994

§ 102(e) Date: Nov. 25, 1994

[87] PCT Pub. No.: WO94/21920

PCT Pub. Date: Sep. 29, 1994

[30] Foreign Application Priority Data

Mar. 25, 1993 [DE] Germany ..... 43 09 687.5

[51] Int. Cl.[6] ..... F04C 2/356; F04C 11/00; F04C 15/00

[52] U.S. Cl. ..... 418/11; 418/139; 418/186; 418/241; 418/247

[58] Field of Search ..... 418/139, 145, 418/186, 187, 240, 241, 245, 247, 253, 11, 12

[56] References Cited

U.S. PATENT DOCUMENTS

| | | | |
|---|---|---|---|
| 701,299 | 6/1902 | Craig et al. | 418/241 |
| 831,933 | 9/1906 | Comly | 418/247 |
| 1,780,614 | 11/1930 | Bolster | 418/241 |
| 1,900,784 | 3/1933 | Zint | 418/187 |
| 1,963,350 | 6/1934 | Campbell . | |
| 2,611,320 | 9/1952 | Morrison | 418/240 |
| 3,303,790 | 2/1967 | McCray . | |
| 4,187,064 | 2/1980 | Wheeler | 418/186 |

FOREIGN PATENT DOCUMENTS

| | | | |
|---|---|---|---|
| 345995 | 11/1904 | France . | |
| 1304017 | 8/1962 | France | 418/186 |
| 410147 | 2/1925 | Germany . | |
| 648719 | 8/1937 | Germany . | |
| 1190795 | 1/1959 | Germany | 418/187 |
| 1553083 | 3/1970 | Germany . | |
| 3638022 | 5/1988 | Germany . | |
| 3724077 | 1/1989 | Germany . | |
| 3724076 | 1/1989 | Germany . | |
| 383538 | 11/1932 | United Kingdom | 418/247 |
| 1121574 | 7/1968 | United Kingdom . | |

*Primary Examiner*—John J. Vrablik
*Attorney, Agent, or Firm*—Antonelli, Terry, Stout & Kraus

[57] ABSTRACT

A fluid conveying device in accordance with the invention includes a housing having an inlet forming a suction side and an outlet forming a pressure side, a cylindrical pumping chamber with intake and discharge openings at opposite sides which respectively are in fluid communication with the suction side and the pressure side and a rotor contained in the chamber having a hollow rotor body mounted for eccentric rotation relative to an axis of the chamber. The body has a longitudinal external surface forming a seal with a circumferential surface of the chamber and a partition contiguous with the external surface dividing the rotor body into an intake side which has an axial intake opening at one end communicating with the intake opening of the chamber and has a radial opening for communicating with the interior of the chamber and a discharge side which has a radial opening for communicating with an interior of the chamber and an axial discharge opening, at the end opposite the intake opening, communicating with the discharge opening of the chamber. A plurality of radially extending sealing vanes are distributed about the rotor. Each vane has an inner end in sealing relationship with a periphery of the rotor body and an outer end which extends through an associated sliding vane opening in a wall of the chamber and slides and rocks within a respective receiving space extending radially outward into the wall of the chamber from the sliding vane opening provided in the chamber wall which contains the vane therein.

39 Claims, 12 Drawing Sheets

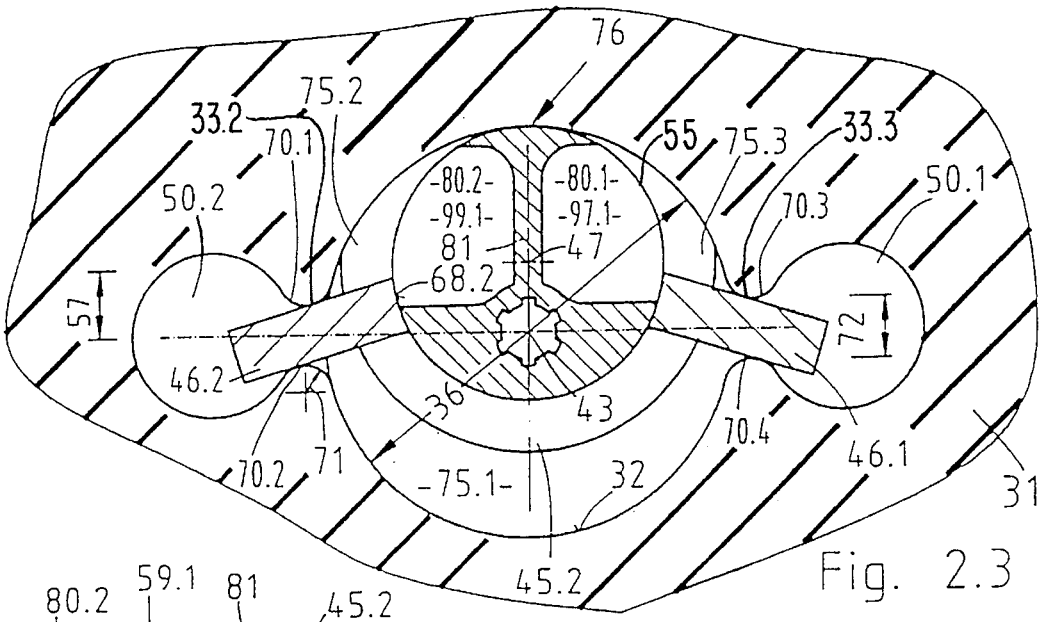
Fig. 2.3
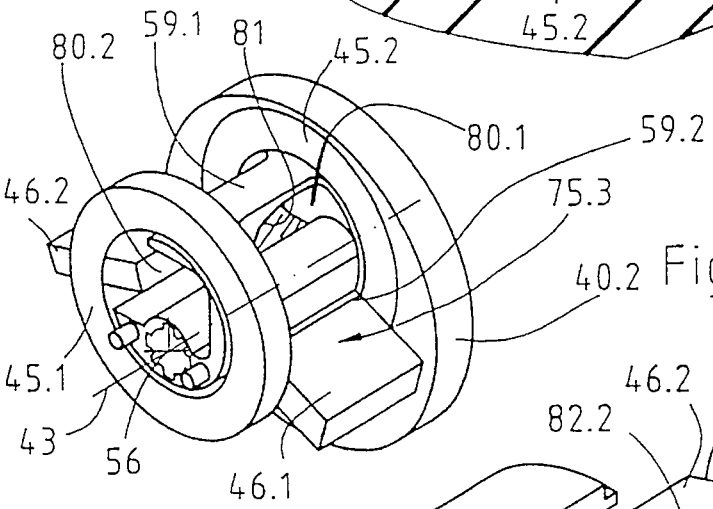
Fig. 2.2
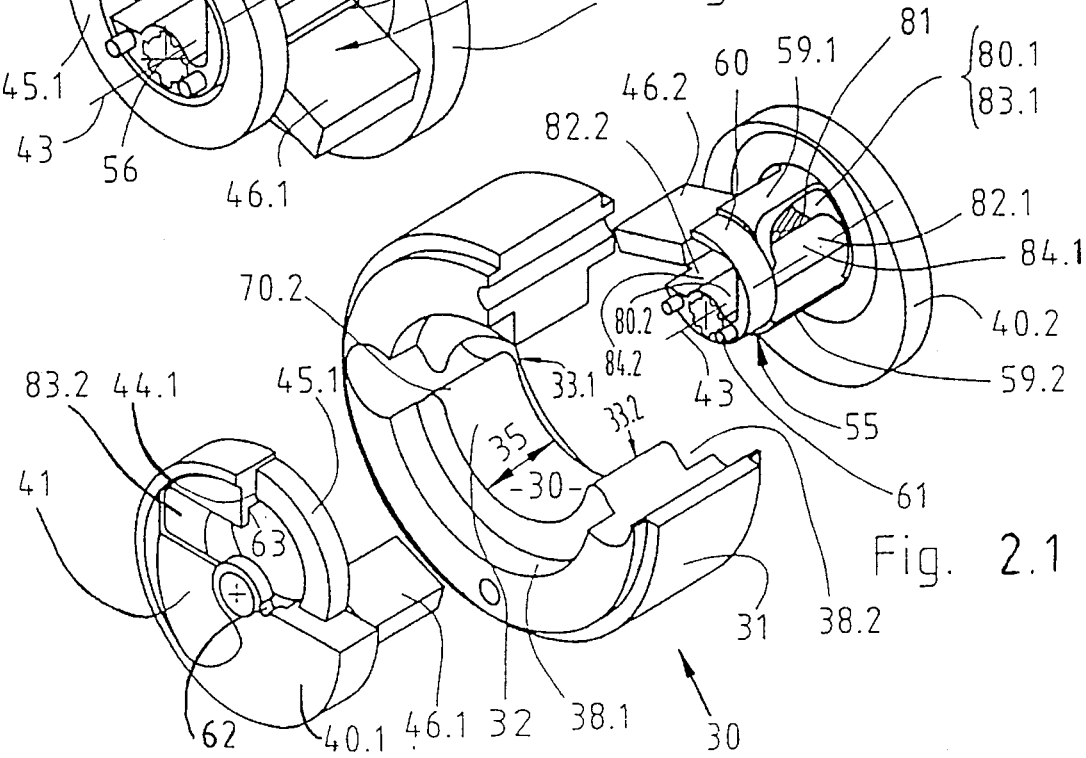
Fig. 2.1

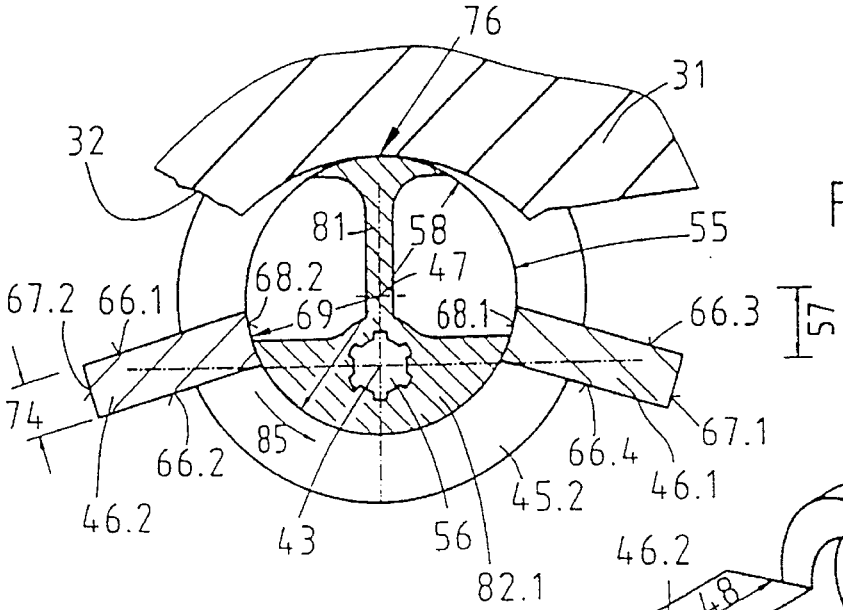
Fig. 2.4
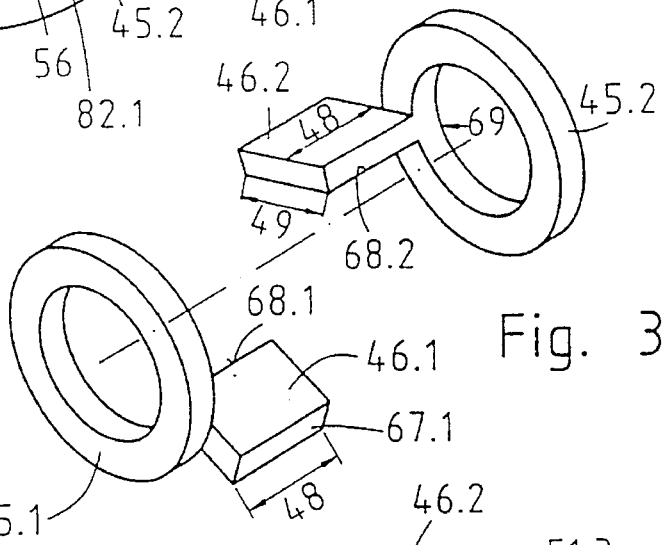
Fig. 3
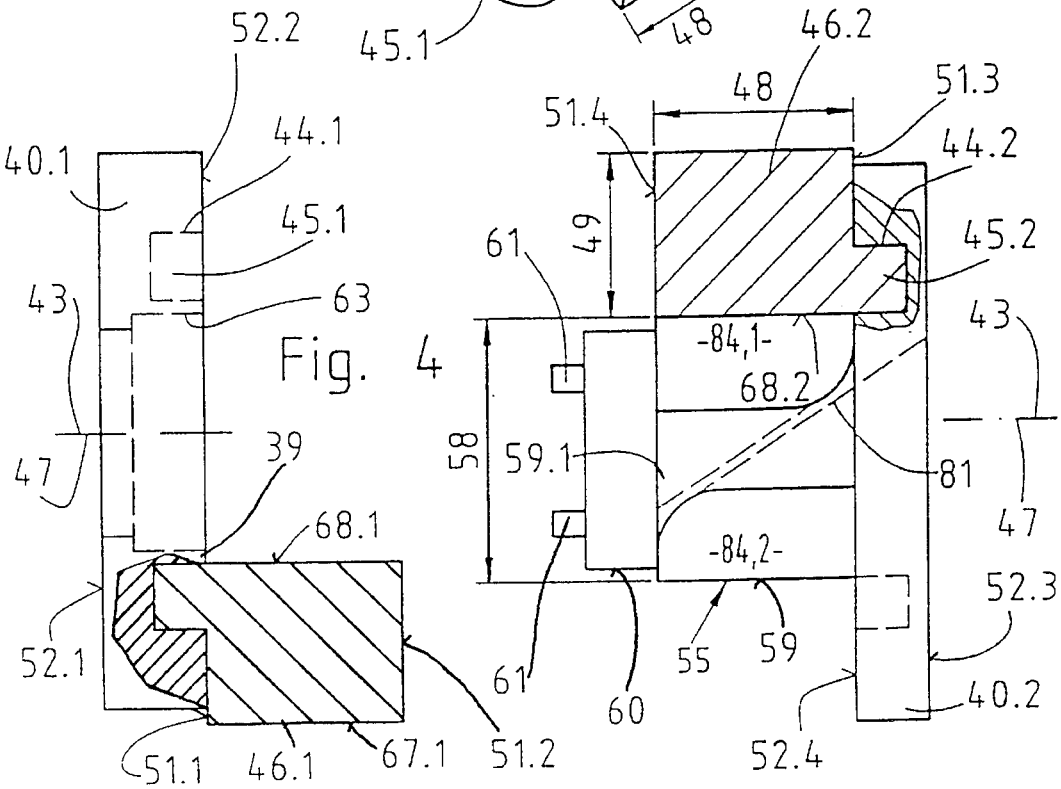
Fig. 4

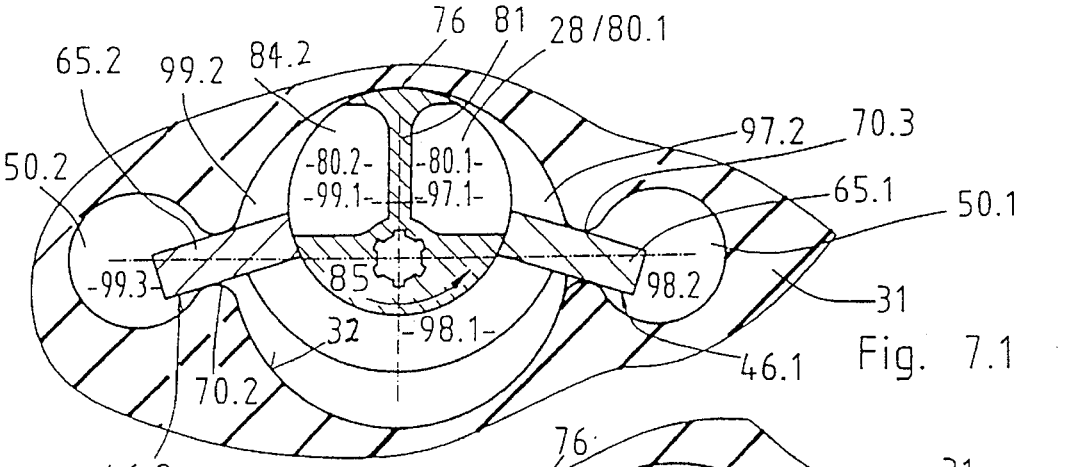
Fig. 7.1
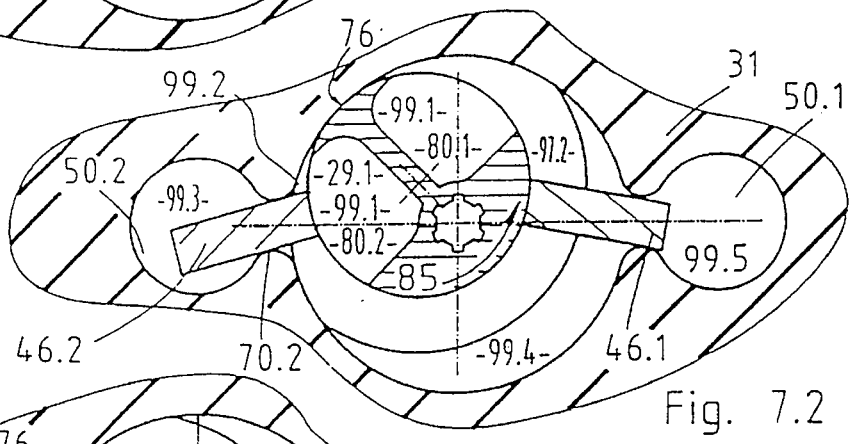
Fig. 7.2
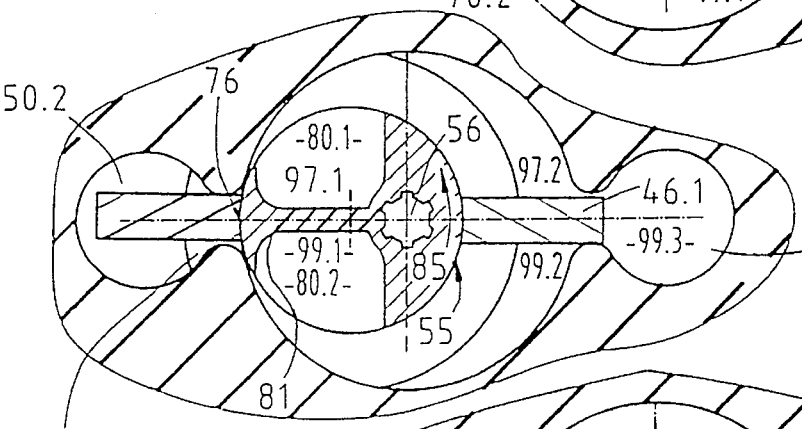
Fig. 7.3
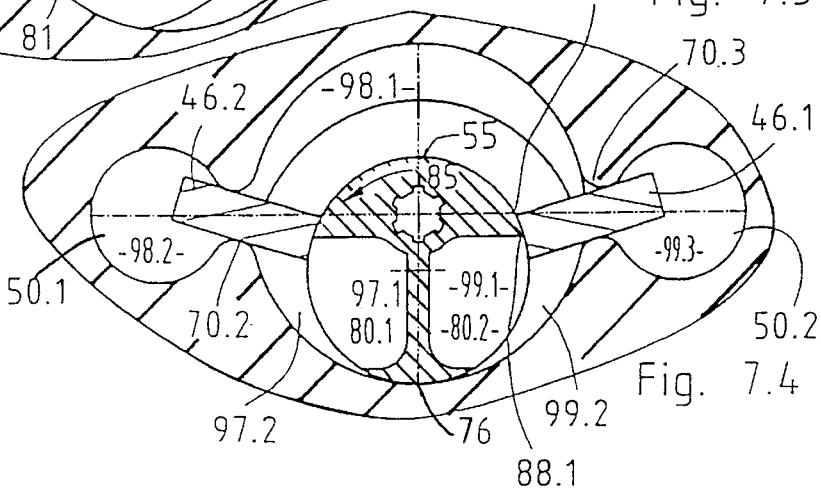
Fig. 7.4

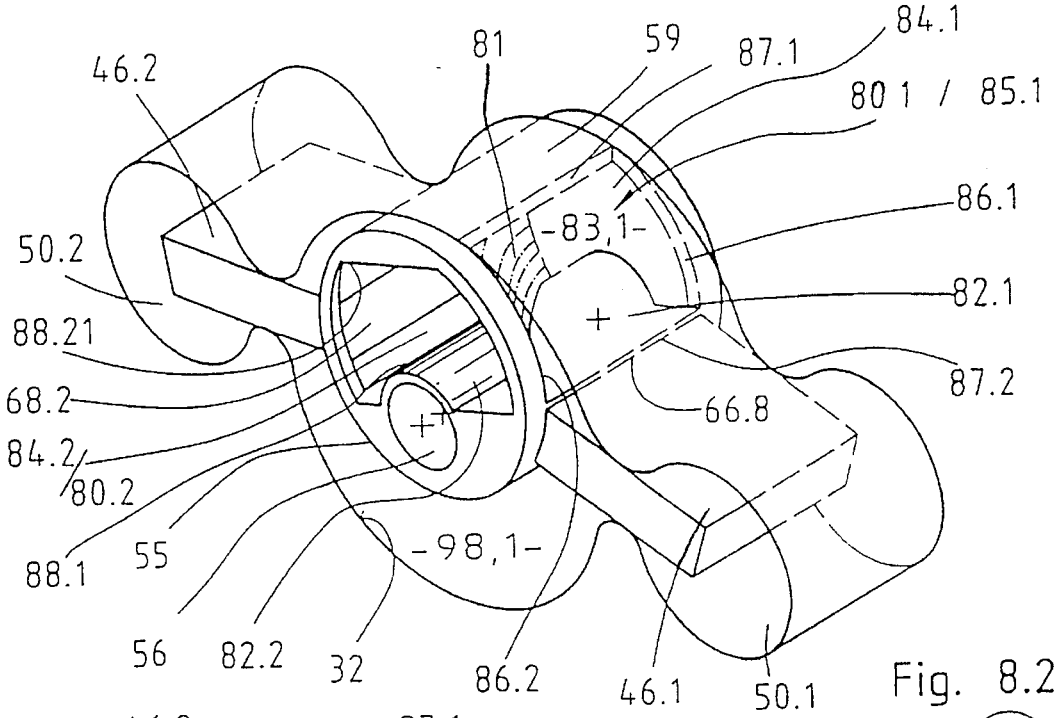
Fig. 8.2
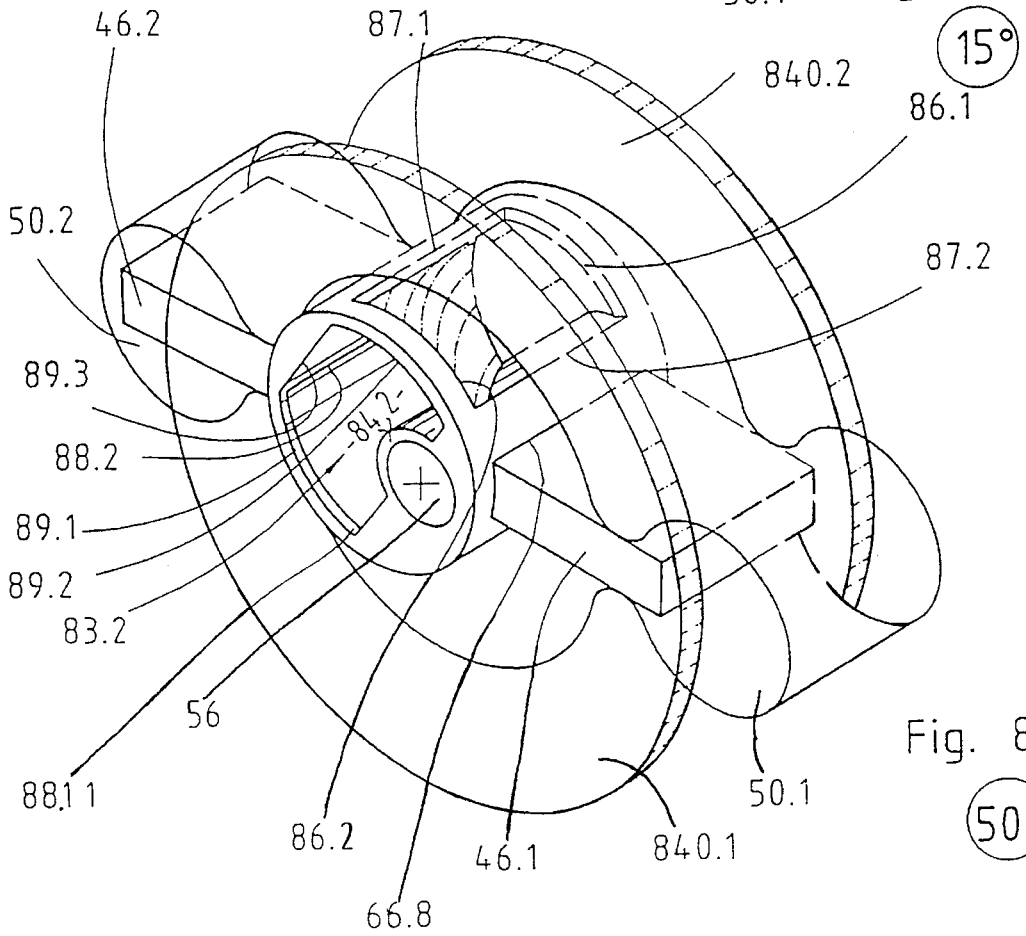
Fig. 8.21

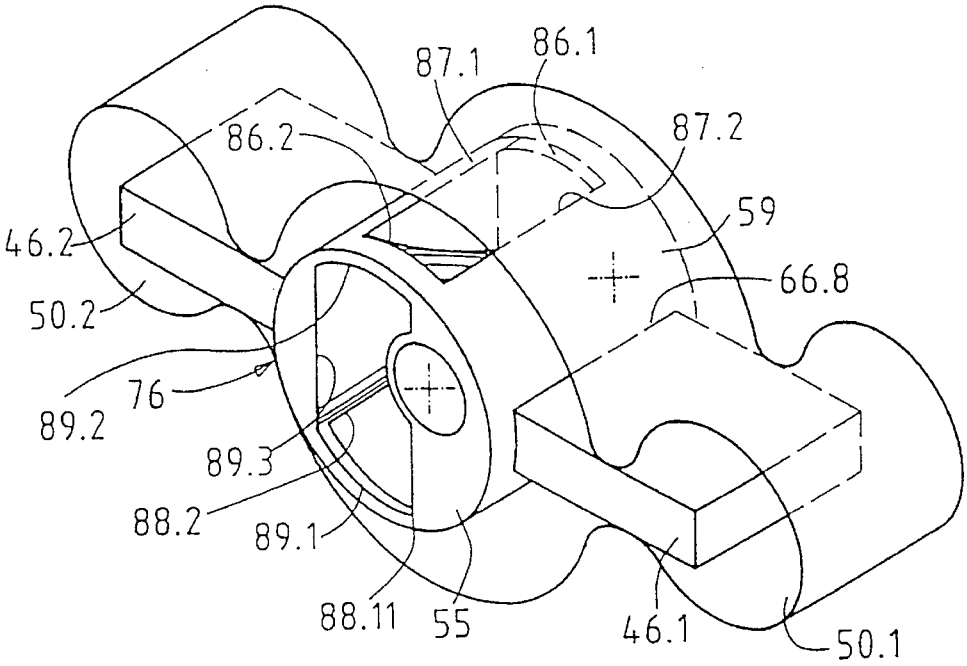
Fig.8.3
90°
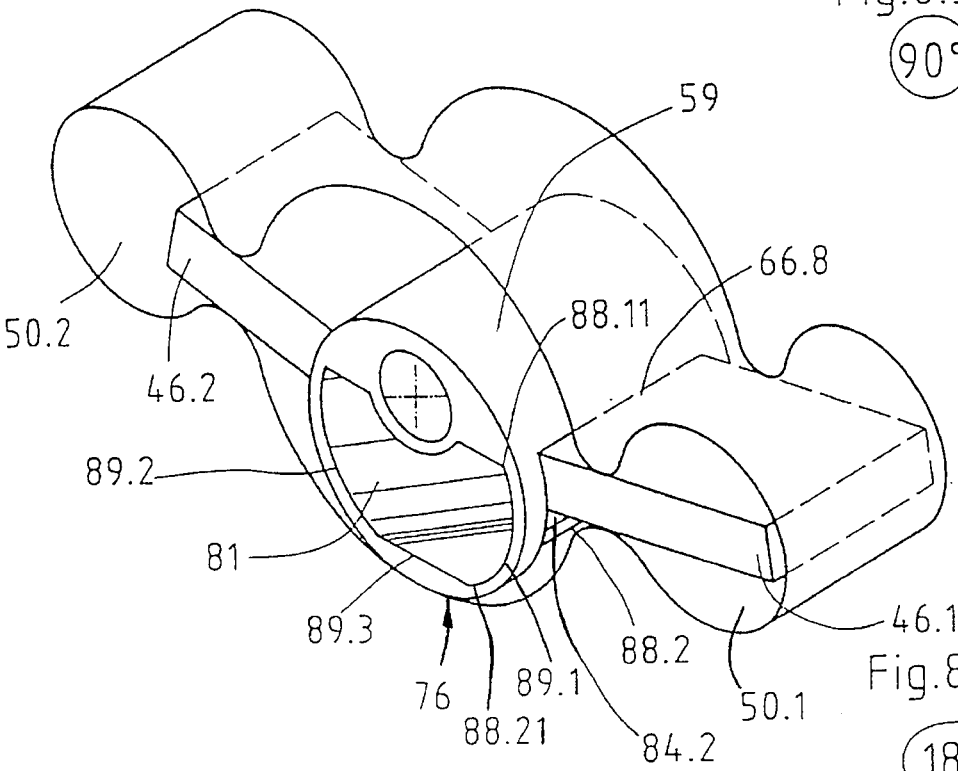
Fig.8.4
180°

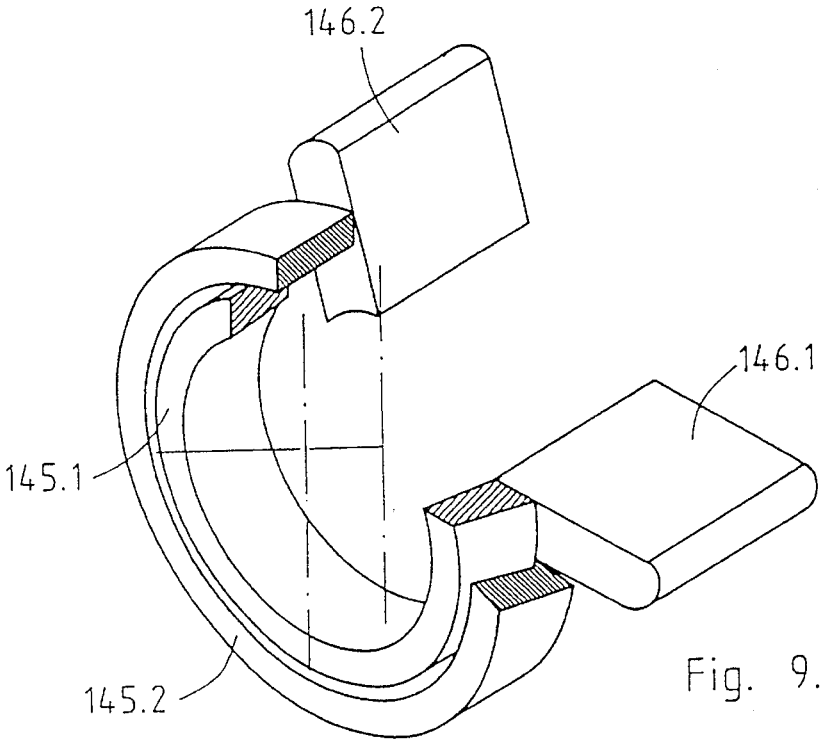
Fig. 9.2
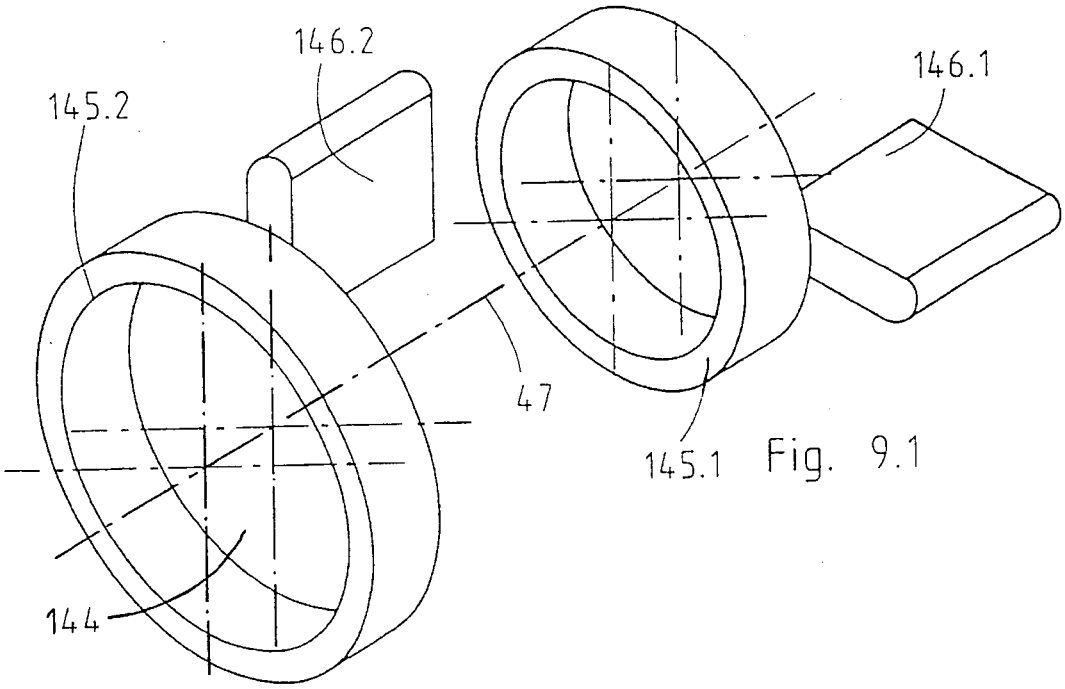
Fig. 9.1

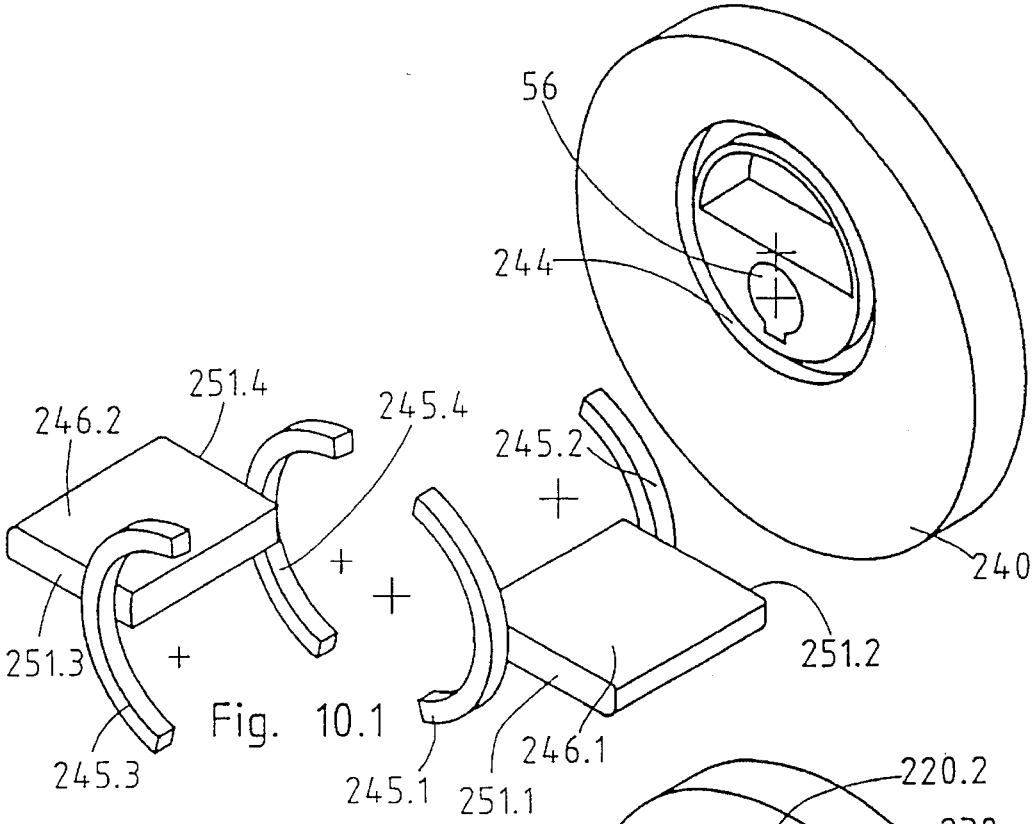
Fig. 10.1
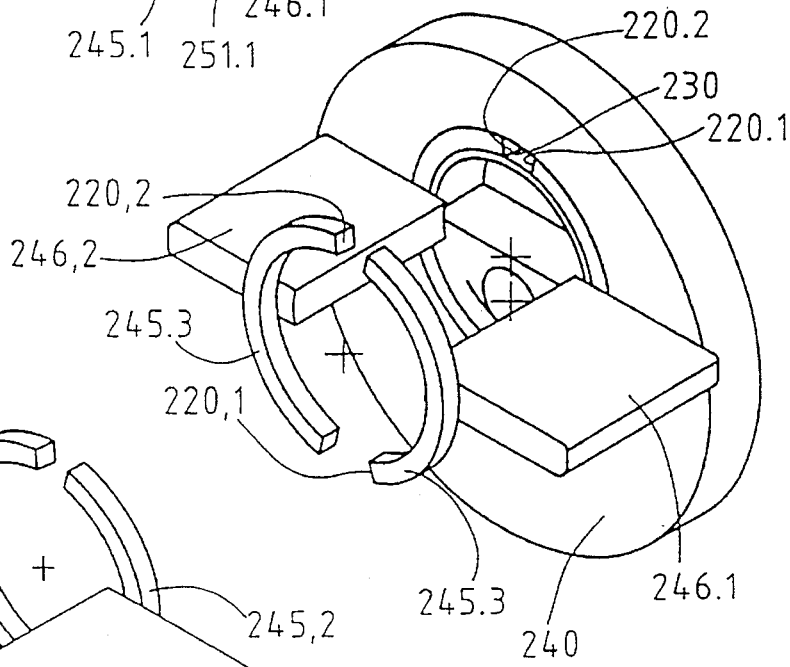
Fig. 10.3
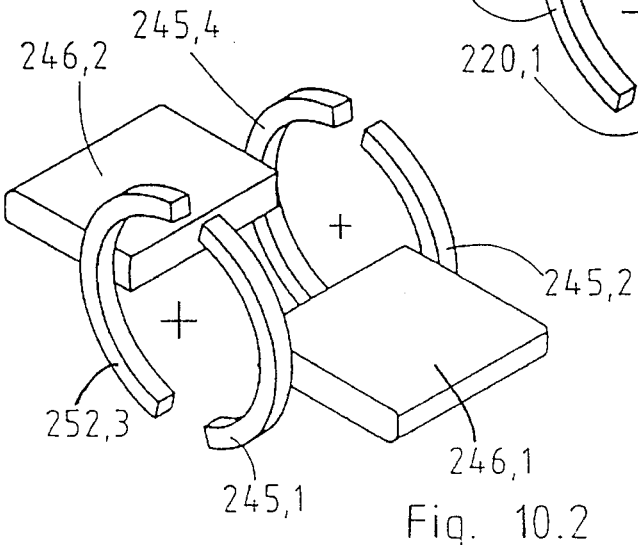
Fig. 10.2

FILLING, FLUID-TRANSPORTING, AND PUMPING DEVICE

The invention relates to a filling, fluid-transporting and pumping device, having an eccentrically guided sliding vane arrangement, which with peripheral sealing regions in a cylindrically delimited pumping chamber effect the sealing between suction side and pressure side, provided with at least two movable sliding vanes and fluid supply and discharge means rotating with the pump rotor and arranged for axial entry and axial discharge of the fluid medium being pumped.

BACKGROUND ART

There exist many pumps, pumping devices, supplying and conducting devices, fluid-transporting devices and the like. Included among them are vane pumps, eccentric vane pumps and sliding vane pumps as well as rotary vane pumps and other pumps having eccentrically moved elements. Many pumps are developed for special applications. Many of these pumps compress the conveying medium for the purpose of transporting. Constituents of the medium to be conveyed and pumped can suffer, especially when conveying foodstuffs and other sensitive goods. Many pumps also produce a discontinuous or pulsating conveying flow. Gentle conveying is important, especially for sensitive goods. In many pumps, such as gear pumps or the like, residual quantities remain in part regions of the transporting elements when the sealing is applied. Surges of high intensity are frequently produced as a result. The pumps therefore have to operate correspondingly slowly or be equipped with additional discharge openings and discharge channels.

The rotary piston machine with fixed abutments and oscillating piston vanes in accordance with DE 648 719 has oscillating piston vanes which are mounted in the outer hollow cylinder. This solution is not comparable with sliding vanes.

The rotary piston pump or the rotary piston motor with external rotor in accordance with DE 37 24 077 has roller-shaped sealing elements in the external housing, and these perform rotary oscillations about their axis and seal in sliding manner by means of an edge on the cylindrical stator. Radially moving sliding vanes which are pushed in and out in accordance with eccentricity are not provided.

Details regarding the supply and discharge of the medium are not discussed. The same applies to the associated documents DE-OS 37 24 076 and 36 38 022.

The rotary pump in accordance with DE-OS 15 53 083—U.S. Pat. No. 3,303,790—has a stator with rubber-elastic vanes which perform tilting oscillating movements in accordance with the elliptical rotor. Radial pushing in an out of sealing sliding vanes is not provided. Otherwise, the construction corresponds to conventional rotary pumps. However, the medium is guided radially and axially by way of the rotor.

The pump in accordance with U.S. Pat. No. 1,963,350 has an eccentrically rotating rotor with a smooth outer wall of cylindrical shape and oscillating sealing elements which are in the shape of part cylinders in the walls of the stator and which are mounted rotatably in the stator on axially parallel spindles arranged in sealing receiving spaces of the stator which are in the shape of part cylinders. No sealing elements are fixed to the rotor. The medium is supplied and discharged axially. Curved guide faces in the interior of the rotor provide for the deflection and control of inlet and outlet. The pumping medium which emerges axially towards the lid is deflected therein and supplied by way of guide openings and apertures to the outlet at the pump stator housing. This pump, which is of technological interest from the point of view of the basic design, chooses sealing elements which are not suitable primarily for pumping media carrying sensitive constituents, such as beverages and foodstuffs which contain raw fruit such as strawberries. The many small spaces and corners can only be cleaned with difficulty. This is primarily also to be attributed to the bearings, provided with relatively small dimensions, the springs required for the sealing oscillators and the like.

DISCLOSURE OF THE INVENTION

The object of the invention is to provide a pump or other pumping and conveying device of the general type mentioned above, which, with an extremely gentle manner of pumping, is constructed from components which are easy to assemble and disassemble and are also simple and cheap to produce, this pump or pumping and conveying device also permitting similar or different pump types to be constructed and used easily in various production runs with few modifications in a manner which is favorable for manufacture and assembly.

According to the invention, the pumping chamber wall is interrupted by sliding vane openings into sliding vane receiving spaces, which are provided at angles to one another corresponding to the number of sliding vanes, and lie substantially opposite in the case of two vanes, and that the sliding vanes are mounted rotatably in relation to the rotor and penetrate by means of their outwardly pointing ends in each case into a respective sliding vane receiving space, and the vanes are guided on sliding vane holding and guiding means mounted to rotate eccentrically with the rotor, which permit sliding vane oscillations.

The sliding vane pump, as far as sealing is concerned, has considerable advantages, since on the one hand a sealing body running peripherally on a cylinder wall produces sealing which covers a relatively large area and which does not significantly damage the pumping medium, and on the other hand the vane can be sealed over a relatively large area and consequently very well sealed. However, the plunger-type sliding vane pump with oscillating plunger results in very uneven conveying flow and therefore cannot be used for foodstuffs, medicines and other high-grade goods. As a result of the arrangement of two or more vanes and their carefully designed form and arrangement, the respective suction and pressure spaces and transporting spaces located therebetween can be constructed in a more favorable manner, and, as a result of the co-rotating arrangement of guide elements for the medium, opening and closing of the various spaces can be carried out at suitable times such that no disruptive pressure surges occur. By a suitable choice of constructional details, it can even be achieved that the conveyed medium can be relaxed between the suction and expulsion thereof. This is of great importance, especially for fruit and fruit constituents in foodstuffs.

Such a filling, fluid-transporting and pumping device is expediently constructed to have a cylindrical main space in or on which collectively driven eccentric guide plates rotate in the region of both ends, the eccentric guide plates having cylindrical ring-shaped guide grooves (annular grooves) in which guide rings (slide rings) which have outwardly projecting vanes which can penetrate in sealed manner into vane receiving spaces can be rotated, and there being arranged in the interior a drive and guide body (rotor) which rotates about the central pump axis of the main space (pumping chamber), but with respect to this pump axis is eccentric such that it runs along the curved inner surfaces (pumping chamber wall) of the main space by means of a sealing surface (sealing arrangement), and the drive and guide body (rotor) having axial and radial inlet and outlet openings which are connected to fluid-guiding channels which are separated from one another by a preferably oblique or helical separating wall. Such a device fulfils the aims of the invention in an outstanding manner and produces an unexpectedly quiet conveying flow which is free of pressure surges or is at least extremely low in pressure fluctuations, even at high speeds. High pressure build-up is possible. As a result of the omission of gears and complicated shaft bearings and the use of simple lathed parts which have had only little milling work or other machining, the pump is cheap to produce. The housing and the components which hold the pump together can be constructed such that all the parts which are subject to abrasive wear—rotor, vane, pump housing—can be replaced easily and can be removed from a pipeline system for exchanging without disassembling the pump. The pump is suitable for a conveying flow to the left or to the right. As a result of the narrow or small gap between the moving parts which separate suction and pressure space, the pump is able to build up a suitable underpressure for suction in conditions which arise in practice.

Pumped media are not compressed in the pump conveying space, which is sickle-shaped during the conveying procedure. As a result of the construction—which depends on the system—of the pump inlet on rotating parts, discrete portions of the medium are not squeezed in the line of separation between suction part and rotor, but cut off sharply. This is important, especially when conveying sauerkraut and spaghetti and similar products.

In the pumps known hitherto, having eccentrically arranged rotors and spaces which have cut outs in the pumping space wall for sealing sliding vanes, the latter are arranged in the housing pivotally about axes parallel to the pump axis, as for example in accordance with U.S. Pat. No. 1,963,350 and DE-A-3724077. This necessitates a corresponding housing bearing. Bearing journals and the like have to be accomodated and sealed. Generally, cleaning such spaces presents major difficulties, and it is possible for residues of the last material pumped, impurities, bacteria and the like to accumulate. In the case of the pump according to the invention, the sliding vane receiving spaces are completely smooth and the sliding vanes, which are radial, or otherwise always at the same angle for support, are borne by way of large rotary rings which run in corresponding grooves. The latter are found in parts associated with the rotor and can thus be removed with it for the purpose of cleaning or at least can be rinsed around better. Moreover, they have comparatively large bearing surfaces which can in some cases be better sealed and wear less and thus eliminate flat valves or sliding vanes mounted pivotally on the rotor periphery. The sliding vanes extend radially in relation to the axis of driving and rotation of the pump, but at the same time oscillate about a plane which lies on the pump axis and the inlet openings of the sliding vane receiving spaces.

Many other eccentric pumps with sealing aids exist, such as hose pumps and combined pumps having sliding vanes. These introduce the medium tangentially into the pumping chamber from the outside and remove it therefrom correspondingly. During this, sickle-shaped pumping spaces are also formed. Most pumps of this type can only operate in pulsed manner. As a result of the axial supply and discharge of the medium and the deflection by way of oblique surfaces and the construction of the inlet openings with control edges in the case of the pump according to the invention, it is possible to achieve a pumping operation which is very little subject to pulsation or is virtually pulsation-free; the two or more sliding vanes enable division into a plurality of pumping spaces whereof the inlet and discharge can be controlled in a gentle manner. Moreover, it is possible in the case of a pump according to the invention to carry along sensitive medium constituents, such as in particular very fresh fruits, while in many other pumps, and in particular also pumps which appear similar, this is not possible.

The device or pump can be constructed, as to important details, in many ways. In this connection, it can especially be provided that the vanes are guided and supported, at least in the inlet region of the sliding vane openings on curved sealing and support faces corresponding to their shape or in slots of rotatably movable sliding vane guide elements.

The transitions from the pumping chamber wall to the sliding vane receiving spaces can be provided by curved bearing sealing surfaces, in which the spacing of the peak edges in the region of the sliding vane opening is slightly larger than the thickness of the sliding vanes.

It can further be provided that the rotor carries the eccentric guide plates, and the vane sealing surfaces of the vanes perpendicular to the pump axis are guided in slidably sealing manner between the planar, inwardly facing plate sealing surfaces of the eccentric guide plates.

It can further be provided that the pumping chamber wall, together with bearing sealing surfaces, is formed by a pump housing which is of rubber or is coated with rubber. This provides advantages, not only for the running properties and sealing, but also with respect to wear and costs and enables inexpensive, rapidly replaceable spare parts to be provided.

Furthermore, with the same basic design of the device, a great many variations of individual structural features can be applied, alone or together with others. Thus, the sliding vane guide elements can be cylindrical bodies of sliding bearing material, whereof the diameter is larger than the penetration depth of the ends of the sliding vanes and has in the region beyond the sliding vane movement a supporting transverse connection and in which there may be constructed relaxation channels. In this case, the pumping space wall, rotor and sliding vane can be of corrosion-resistant steel or other metal and the sliding vane guide elements can be of a synthetic material possibly equipped with an agent promoting sliding. This is particularly important for pumps which, because of the media to be pumped, are to be made at least in most regions of certain steel materials and yet are to have good sliding and running properties.

It can furthermore be provided that the sliding vane receiving spaces are formed to be approximately triangular in cross-section in correspondence with the angle of pivoting of the respective sliding vane, and/or that three sliding vanes are formed with associated sliding vane receiving spaces and possibly guide and sealing elements. In particular, in this connection it can be provided that the sliding vanes are constructed as flat plates whereof curved inner end sealing surfaces are constructed on guide surfaces of the drive and guide body operating as a rotor, bearing on one another with the same radius.

Furthermore, it can advantageously be provided that a sealing strip is arranged in the inner end sealing surface of each sliding vane oscillating on the outer wall of the rotor. For this, it can be provided that there is made in the metal sliding vane a sealing groove in which there is arranged a sealing strip made of a synthetic material compatible with the material of the rotor and the medium to be pumped.

In a particularly advantageous arrangement the sliding vanes are mounted so as to be rotatably movable by means of slide rings or partial slide rings rigidly connected thereto, and the slide rings or the partial slide rings are guided so as to be rotatably movable in annular grooves which are formed in eccentric guide plates which are arranged with their end faces towards the cylindrical pumping space and rotate eccentrically with the rotor and which also form wall portions and are associated with the holding and guiding means of the sliding vanes.

In the first-mentioned arrangement the annular groove will contain no wasted space to receive the pumped medium. In the second arrangement there is very little such wasted space. The vanes are suspended at both ends and can be symmetrically supported in an improved manner even at to resist high loads due to high pressures, so that bending and twisting forces are reduced. The sealing and the rubbing surfaces are not loaded unfavourably and quieter running can be achieved.

Both arrangements are individually designed according to the application of the pump, the pumps being correspondingly designed and assembled. Vanes mounted on a slide ring at one end only are easier to instal. Vanes mounted at both ends need corresponding allowances in the dimensions of the pump chamber, vane receiving spaces, transfer openings etc. for installation of the nested components. If the slide rings are fixed to the vanes at both ends the openings must permit assembly and dismantling. With partial slide rings, these should have the same inside and outside radii and the angular extent is to be such that it is reduced at least by the pivot angle of the associated vane. In each form, the vanes can be constructed or secured on slide rings located outside the sealing surfaces which are perpendicular to the pump axis.

In another advantageous embodiment two rings of different size are arranged in corresponding annular grooves on one side of the rotor. This enables the pump to be more freely designed at the other side, or permits better support.

It can further be provided that the vanes, with their slide rings, are formed as identical components constructed in one piece.

It can further be provided that the eccentric guide plates rotate in sealed manner by means of their outer plate sealing surfaces on large-volume O-ring seals which are inserted in the end walls of the pumping chamber housing.

It can further be provided that the rotor inlet channel and rotor outlet channel have an inlet opening and an outlet opening respectively facing in different directions and have a pumping chamber inlet opening and a pumping chamber outlet opening respectively which are open towards the outer periphery of the rotor.

In the region of its sealing surface rotating on the pumping chamber wall, the rotor may deviate from the basic external outline of the rotor in such a way that it is formed with a radius equal to the radius of the pumping chamber wall.

To increase the conveying capacity and/or to provide other advantages, two pump units can be arranged one behind the other on the same axis in such a way that the pump closest to the inlet contains the low-pressure part and the pump closest to the outlet contains the high-pressure part and medium supply channels in the rotors of the two pumps are arranged so as to pass into each other. Thus the discharge side of the first pump forms an intermediate pressure transfer to the intake of the high pressure pump unit.

The pump of the invention, with the medium path through a rotating central rotor body and corresponding intake and discharge openings and oblique guide surfaces and control edges, lends itself well to such an arrangement.

It can further be provided that the drive shaft is guided through the inlet space for the pumped medium and the admission of pumped medium is effected either in annular manner or through a lateral inlet connection piece, while the outlet space is arranged below the perpendicular drive shaft of the pump.

Devices which contain some or all of the above-mentioned features enable devices which are particularly easy to assemble, to be constructed. Here, the pump can be constructed to be self-cleaning. In this case, it does not need to be taken apart for cleaning purposes and despite this satisfies high hygienic requirements and enables many disassemblies for cleaning purposes to be dispensed with in most foodstuff-processing plants.

Pump parameters are far more favorable than those of a rotary piston pump, since the conveying flow is not divided and also much larger volume portions for each conveying section are displaced to the pressure side. The pumping system contains a rotating eccentric hollow body having strippers or vanes which are supported on the end faces and are guided in sealed manner and which are displaced in rotary and pivotal manner in accordance with the rotary, pivotal and displacement movements of the eccentrics in a housing during the rotation of the rotating parts and are supported during this in the housing on supports for the strippers or vanes which are angularly offset, by 180° in the case of a two-vane pump.

Embodiments of the invention will be described below with reference to the accompanying drawings, in which:

BRIEF DESCRIPTION OF THE DRAWINGS

FIG. 2 shows a partially exploded illustration, which is composed of several parts, of the central pump region proper, with the elements for suction, further conveying with relaxation, and expulsion of the pumping medium:

FIG. 2.1 shows an exploded oblique view of the pump housing, in the center the rotor with an eccentric guide plate and an inserted slide ring with the suction-side vane and at the front the pressure-side eccentric guide plate with an inserted slide ring with the vane;

FIG. 2.2 shows an oblique view of the assembled elements: rotor, eccentric guide plates and slide rings with vanes;

FIG. 2.3 shows a section perpendicular to the pump axis, to illustrate the mounting conditions;

FIG. 2.4 shows detail from FIG. 2.3, in section, with the rotor, both vanes, a slide ring located at the rear and a portion of the pump housing;

FIG. 3 shows an oblique view of the two insert parts which, in each case as a one-piece component, show the vane and its slide ring, in an exploded illustration of their spatial association;

FIG. 4 shows a horizontal section through the center of the two slide rings, with the two vanes in the inserted state on the left in the eccentric guide plate and on the right in the unit comprising rotor and eccentric guide plate;

FIG. 7 shows four similar illustrations 7.1, 7.2, 7.3 and 7.4 of a partially schematic cross-section through the actual pump region, with its essential elements in four different phases of rotary position.

FIG. 8 shows a multiple, highly diagrammatic perspective illustration 8.2, 8.21, 8.3 and 8.4 which shows the details illustrated in the multiple illustration of FIG. 7 in one plane, in a clearer, three-dimensional form of the rotation of the rotor together with its openings and/inner deflection surfaces;

FIG. 8.2 shows a perspective illustration which corresponds in its position to FIG. 7.2, in which the end walls of the pumping space have been omitted and only the outlines of the pumping space and the sliding vane receiving spaces have been illustrated for the sake of clarity;

FIG. 8.21 shows an illustration corresponding to that of FIG. 8.2, with the wall plate covering the pumping space on the adjacent regions in a diagrammatic illustration, the rotor and the sliding vanes adopting a position which is turned slightly further to a position 50° to the upper vertical;

FIG. 8.3 shows an illustration, corresponding to FIG. 8.2, in the position of the rotor and the sliding vanes corresponding to that of FIG. 7.3; and FIG. 8.4 shows an illustration, corresponding to the perspective illustrations mentioned above, in the position of the rotor and the sliding vanes in accordance with FIG. 7.4.

FIG. 9 is a multiple-section oblique illustration of a first variant with two sliding vanes, which are mounted on slide rings located on the same ends of the two sliding vanes and insertible one into the other, wherein further pump components are omitted. In FIG. 9:

FIG. 9.1 is an exploded illustration; and

FIG. 9.2 is an oblique view in the assembly arrangement;

FIG. 10 is a multiple-section oblique illustration of a further variant of important pump parts, wherein the sliding vanes are secured to partial slide rings and the latter are provided on both sides of each sliding vane and are formed in such a way that they can run in the same sliding groove of a guide plate, and wherein FIG. 10.1 is an exploded view of the parts; and FIG. 10.2 is a partial illustration of two sliding vanes with the four partial slide rings thereof in the assembly position; and FIG. 10.3 is an oblique view, in which the partial slide rings located at the rear are arranged in the annular groove of one eccentric guide plate, while the front eccentric guide plate has been omitted for the sake of clarity;

BEST MODE FOR CARRYING OUT THE INVENTION

Figure 1:
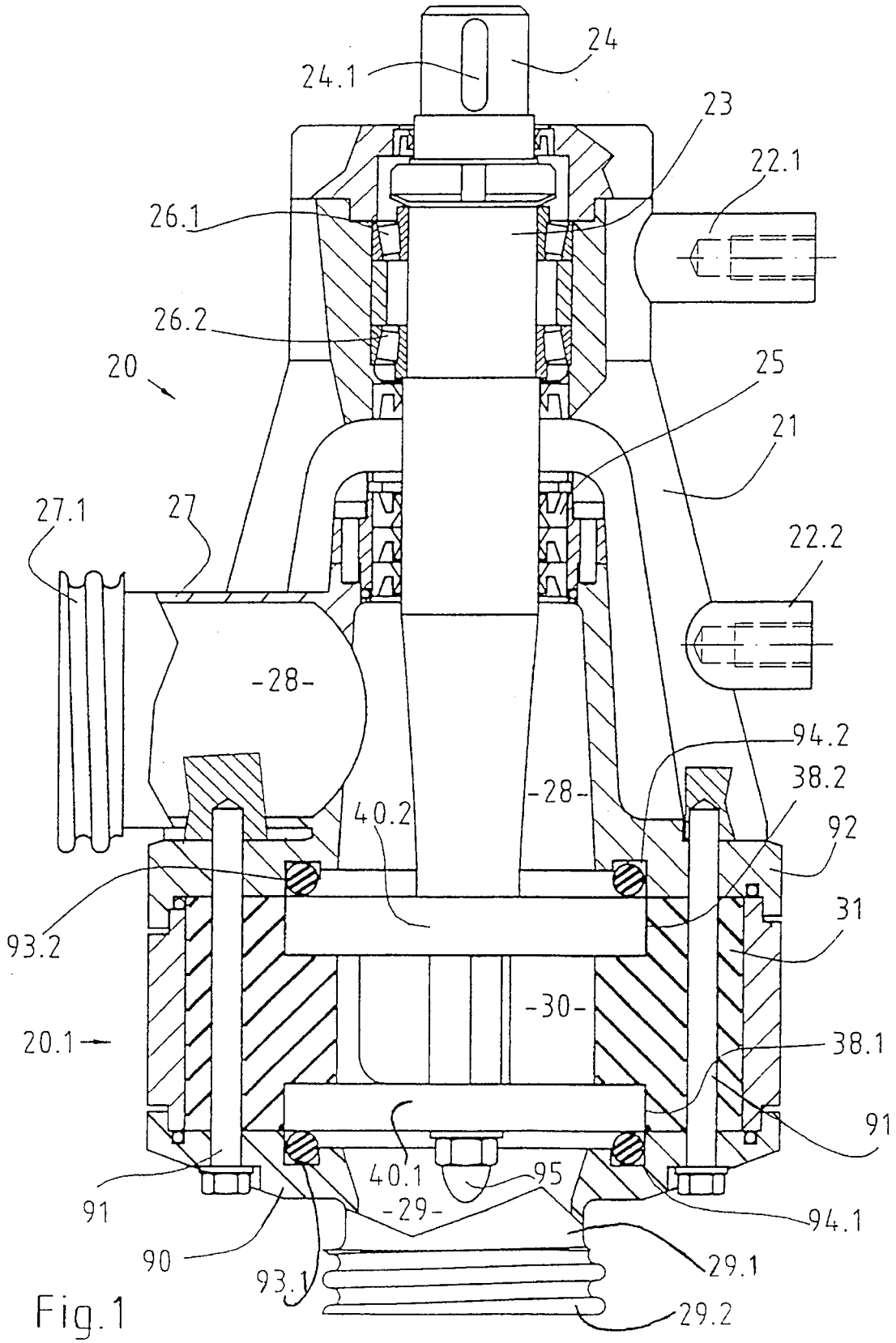
FIG. 1 shows a vertical section through a pump, having a bearing and sealing housing and an inlet and outlet connection.

The pump 20 shown in FIG. 1 has a bearing and sealing housing 21 which is equipped with mountings 22.1 and 22.2. The latter can be used to secure it into an assembly or to a supporting device. A drive shaft 23 has a connection stub 24 with a key groove 24.1 for rotation by means of a driving motor. Two taper roller bearings 26.1 and 26.2 support the drive shaft 23 radially and axially in the bearing and sealing housing 21. An inlet union 27 with a screw-on thread 27.1 leads into an inlet space 28 in the bearing and sealing housing 21, which inlet space is sealed off from the external environment with the aid of sealing rings 25 and is penetrated by the drive shaft 23. It forms part of the suction side. The pump proper 20.1 is arranged in the region located below the inlet space 28. It is described in more detail in particular with reference to the further figures. Because of the complexity of the individual constructions and arrangements, only contours of individual components in one plane are illustrated in FIG. 1. The outlet union 29.1 serves to connect the pressure side to the conveying lines to further devices of the plant.

The pump 20.1 has at the bottom a housing cover 90 which is securely fastened to a flange 92 of the bearing and sealing housing 21 by means of screws 91 which penetrate through an interposed pump housing 31. O-ring seals 93.1 and 93.2 are provided in associated grooves 94.1 and 94.2. Eccentric guide plates 40.1 and 40.2 can rotate in a sealed manner against these O-ring seals. The eccentric guide plates 40.1 and 40.2 are both rotatably driven by the drive shaft 23 through splines in the drive opening 56 and rotate in the pump housing 31 in annular control rebates 38.1 and 38.2. The pump housing 31, which can be seen in more detail in FIGS. 2.1 and 2.3 and the further figures, is here produced from a resilient material, such as rubber with a natural and/or synthetic base or from a suitable plastics with other base materials. However, with appropriate pairing with the rotating parts, it can also be produced from other suitable materials, for example various steels, metals and/or alloys. A nut 95 holds the pump parts securely on the drive shaft 23 and enables them to be easily loosened and removed, and reinstalled and secured.

The actual pump region 20.1 of the illustrated pump is first described with reference to the several views in FIG. 2. An assembled aggregate pump can be seen in FIG. 1. Various variants and installation applications of the novel pump can be derived therefrom.

The pump 20.1 is a sliding vane pump equipped with two vanes and eccentric guidance thereof, in which the supplying and discharging of the medium to be conveyed is effected in a novel manner by way of co-rotating guide elements. The pump 20.1 has a pump housing 31, which is also called a stator, and has a cylindrical pumping chamber 30 (FIGS. 1, 2.1) whereof the cylindrical wall 32 has vane openings 33.1 and 33.2. This defines two cylinder parts of the pumping chamber wall 32 which are separated from one another by the two vane openings 33.1 and 33.2. The length 35 and the diameter 36 of the cylindrical chamber 30, together with further parts and structures, determine the volume of the pump. The wall 32 terminates on each side at a respective rebate 38.1 and 38.2 which is also cylindrical. The eccentric guide plates 40.1 and 40.2 are located in these rebates 38.1 and 38.2, which are of shoulder-type construction. The guide plates are flat cylindrical plates and each has individual inlet and outlet openings 83.1 and 83.2 which are structurally delimited in many planes, are described in more detail below and, because it is difficult to describe such forms clearly, can in some cases only be inferred from the drawings; some with shaped outflow surfaces 41. On the side of each plate facing the pump interior, there is a cylindrical annular groove 44, which is arranged eccentrically with respect to the pump axis 43, for receiving the respective slide ring 45.1 and 45.2. The vanes 46.1 and 46.2 are respectively securely attached to each slide ring 45.1 and 45.2, projecting outwardly radially with respect to the centre point 47 of the control rebate 38.1 and 38.2. In this embodiment, two identical slide rings 45.1 and 45.2 constructed with the same dimensions are located one on each side of the pumping chamber 30 and in each case carry one of the two vanes 46.1 and 46.2 operating in the pumping chamber 30. The center 47 and the associated axis 47 are eccentric relative to the pump axis 43.

Each vane 46.1 and 46.2 has a length 48 which is equal to the length 35 of the pumping chamber wall 32. Each vane has a radial depth 49 such that it can reach sufficiently far into the vane receiving spaces 50.1 and 50.2 through the vane openings 33.1 and 33.2 respectively. The vane receiving spaces 50.1 and 50.2 in the case of a construction with two vanes—as in this embodiment—are arranged exactly diametrically opposite one another with respect to the pump axis 43. The vanes 46.1 and 46.2 are equipped with planar, rectangular sealing surfaces 51.1, 51.2, 51.3, 51.4 which form sliding sealing surfaces for eccentrically constrained relative displacement movements relative to the guide plates 40.1, 40.2.

A multiple profiled rotor 55 serves for the guidance of pumped medium and for rotary driving. The rotor 55 has a drive opening 56 which is equipped with internal splines or can have a differently profiled construction of the engagement opening about the central pump axis 43. The drive shaft 23 is engaged by means of external splines or the like. This drive opening 56 is formed in the rotor 55 so that its axis 43 is offset with respect to the eccentric axis 47 by the amount of eccentricity 57 (FIG. 4, right side), as FIG. 2.3 illustrates in particular.

The rotor 55 is cylindrical in its basic structure and has a plurality of spatially structured apertures. The parts of its outer wall 59 which slide on the adjacent parts and are not absent as a result of apertures or depressions are located on a cylindrical surface having a diameter 58. The axis of this cylindrical surface is the eccentric axis 47. The guide surfaces 59.1 and 59.2, which are envelope surfaces, can be seen. The seal 76 providing a separation between the suction region and pressure region of the pumping chamber is the part of the outer wall of the rotor 55 which, with respect to the pump axis 43, is located outermost and runs in a circular path along the pumping chamber wall 32 with a small radial clearance forming a double-wedge sealing gap. The rotor has a further outer centering surface 60 which serves for positioning and is located on cylindrical curved surface parts having a somewhat smaller diameter than surface 59 and occupying a relatively large angle range. Located between this centering surface 60 serving for secure positioning and the cylindrical annular groove 44.1 in the eccentric guide plate 40.1 is a thin-walled rotary guide collar 39, on the outer surface of which the slide ring 45.1 performs its rotary oscillations.

The cylindrical rotor 55 is integrally formed in one piece with the other eccentric guide plate 40.2 or is non-rotatably and immovably connected thereto in some other manner. It is inserted non-rotatably in the eccentric guide plate 40.1, located at the front in FIG. 2, with the aid of alignment pins 61 and alignment pin receiving holes 62, the centering surface 60 entering a guide rebate 63, which is constructed as a shoulder and is open on the axially and radially inner two sides.

The slide rings 45.1 and 45.2 are rotatably inserted in the annular grooves 44.1 and 44.2 with a smooth-running sliding fit. When the rotor 55, with its two eccentric guide plates 40.1 and 40.2, rotates, the rings 45.1, 45.2 only oscillate to and fro, since—as can be seen in FIG. 2.3—the vanes 46.1 and 46.2 are held in the openings 33.1 and 33.2 and therein can only perform angular oscillations and enter and exit radially, as determined by the rotary movements of the eccentrics. Here, the ends 65.1 and 65.2 enter the vane receiving spaces 50.1 and 50.2 or exit therefrom in accordance with the amount of eccentricity 57.

The vanes 46.1 and 46.2 are approximately square or rectangular plates which are delimited by parallel sealing surfaces 66.1 to 66.4 and whereof the radially outer end surfaces 67.1 and 67.2 can be of any desired formation, while the inner end sealing surfaces 68.1 and 68.2 are concavely part-cylindrically delimited by the radius 69 which corresponds to the external diameter of the cylindrical curved part surfaces serving for guidance and sealing, in particular the guide surfaces 59.1 and 59.2, so that the respective vane can oscillate to and fro in sealed manner on the guide surfaces 59.1 and 59.2 of the rotor 55 and between the inner surfaces 52.2, 52.4 of the two eccentric guide plates 40.1 and 40.2 when the rotor 55 rotates. The sealing surfaces 51.1–51.4 have been discussed above.

The bearing sealing surfaces 70.1 to 70.4 between the two parts of the pumping chamber wall 32 and the spaces 50.1 and 50.2 are—as can be seen in FIG. 2.3—convex part cylinder surfaces having the radius 71. The spacing 72 between their peaks is larger than the thickness 74 of the vanes 46.1 and 46.2, so that the latter have sufficient play to allow them to move. The bearing sealing surfaces 70.1 to 70.4 can also have a shape corresponding to the exact path of movement of the sliding vanes 46.1 and 46.2 and their sealing surfaces, or the surfaces contributing in each case to sealing can be formed with different surfaces shaped to match the movements and shape-generating lines. Sealing with a very precise spacing on both sides of the sealing vanes 46.1 and 46.2 is therefore not necessary, since the vane-like sealing vanes 46.1 and 46.2 can move relatively freely in freely guided manner by means of their freely rotatable slide rings 45.1 and 45.2 and are pressed against the one or the other side in completely sealing manner by the respectively higher pressure of the medium being pumped. Consequently, the receiving spaces 50.1 and 50.2 are at the respective pressure level which corresponds to the free sealing side. Since the gaps formed during this are narrow, relatively large constituents of the pumped medium do not pass into spaces 50.1 and 50.2. Relatively large constituents are located in each case only in the sickle-shaped media-displacement spaces. One of these media-displacement spaces can be constructed to be in two parts. The space regions of the pumping chamber 30 are divided by the sealing arrangement 76.

The rotor 55, which also serves to guide the pumped medium in the chamber 30, has a generally radial spatially profiled separating wall 81 which runs between a rotor inlet channel 80.1 and a rotor outlet channel 80.2, is oblique and/or approximately helical, separates the two from one another in sealing manner and is constructed in one piece with the surrounding walls 82.1 and 82.2 of the rotor wall parts surrounding the drive opening 56, provided with internal splines, and the wall parts of the rotor 55 forming the guide surfaces 59.1 and 59.2.

The rotor inlet channel 80.1 and the rotor outlet channel 80.2 respectively form an inlet opening 83.1 and an outlet opening 83.2 which open axially in opposite directions and in at least partially profiled manner and respectively form a pumping chamber inlet opening 84.1 and a pump chamber outlet opening 84.2 which are large in area and open radially into the pumping chamber 30. FIGS. 2.2 and 2.3 show how the rotor inlet channel 80.1 opens into the pumping chamber region 75.3 which is located at the top right-hand part here, while, although it cannot be seen individually in detail, the rotor outlet channel 80.2 opens into pumping chamber region 75.2. These media displacement and pumping regions, depending on the rotor position and—as can be seen in FIGS. 7.1 to 7.4—as a result of the positions of the vanes 46.1 and 46.2, are semisickle-shaped or part sickle-shaped, either or both pointed edges being omitted. This alters continually during the rotation and leads, in the largest part 75.1 of the pumping chamber 30 which is located between the two vanes 46.1 and 46.2 and is the part blocked off from inlet and outlet, to the very relaxation which is so advantageous for fruit constituents of the conveyed medium and thus very quiet running of the entire pump and all the connected parts of the plant in which it is installed.

The pair of parallel lines 81 in FIG. 4 indicate the partition 81, here hidden. Relative to the general orientation of the various sections, in particular in the perspective views, FIG. 4 is turned through 90. The perspective views in other Figures show the position of the partition 81.

The pump core parts illustrated are located between housing connection parts which respectively have an inlet space 28 and an outlet space 29 which are open to the pump parts and which have end sealing surfaces with the O-ring seals 93.1 and 93.2 (FIG. 1) inserted therein. The end surfaces of the eccentric guide plates 40.1 and 40.2 rotate on these large-sized O-ring seals.

The pump is one which in the same structural parts are similar to the rotary sliding vane pump, but differs in that the vanes do not rotate in frictional manner on the outer surface of the pumping chamber, but enter receiving spaces and are displaced to and fro with their flat lateral sealing surfaces 66.1–66.4 in sealed contact on the contact sealing surfaces 70.1–70.4 of the stator and are pressed thereagainst under the pressure of the medium and oscillate up and down about the peaks of the bearing sealing surfaces. Moreover, the pumped medium here enters axially by way of the rotor inlet channel and is deflected by the oblique and/or helical rotor surface of partition 81 to a radial outlet, then it radially enters the rotor discharge channel which has an oblique and/or helical surface and then in turn axially exits.

Because the opening to the inlet and the outlet space is wide for long rotating times, no compression of the medium takes place in the sickle spaces, but portions of the medium are received in portions, are cut off between the various sealing surfaces and are conveyed to the outlet, so that sensitive portions of medium, such as fruit or the like, are not compressed. The part-cylindrical sealing arrangement 76 running along the pumping chamber wall 32 also contributes to this end.

Description of functioning:

The illustrated pump 20/20.1 is suitable for many kinds of pumped media and can be constructed suitably by appropriate materials and material pairings or particular constructions. It is particularly intended for foodstuffs and designed especially for high hygiene requirements. The pumped media can also contain sensitive constituents, such as fruit or other foodstuff constituents. They can also comprise chemically aggressive substances or contain them. The pump can also be used for dairy products, beverages, cosmetics, pharmaceuticals and many other liquid and viscous materials.

The medium to be conveyed enters the inlet space 28 through the inlet union 27 and passes out through the outlet space 29 in the outlet union 29.1. Here, the pumped medium can be drawn in by suction by the pump 20/20.1 or can be supplied by free fall or under natural liquid pressure out of a funnel or reservoir. It can leave the outlet union 29.1 under pressure. This pressure is determined according to the conventional dimensioning standards of pumps and according to the sealing conditions, in particular according to the sealing gaps and the flow conditions therein. They are particularly favourable in the construction and the embodiment possibilities described. Relatively high pressures in relation to other pumps can therefore be achieved and surprisingly uniform conveying flows which are low in pressure surges.

Starting at the position shown in FIGS. 7.1, the medium enters the regions 97.1, 97.2. As the rotor turns to the position shown in FIGS. 7.2, 8.2 and then through the positions shown in FIGS. 7.3, 8.3 and then to that of FIGS. 7.4, 8.4, the medium drawn in by suction is accommodated partly within the rotor, and partly in the region above it and the vanes 46. When the rotor reaches the position shown in FIG. 7.4, the in-drawn medium is divided into two portions namely, the portion within the regions 97.1 and 97.2 below the vane 46.2, and a completely isolated portion in the region 98.1.

Figure 6:
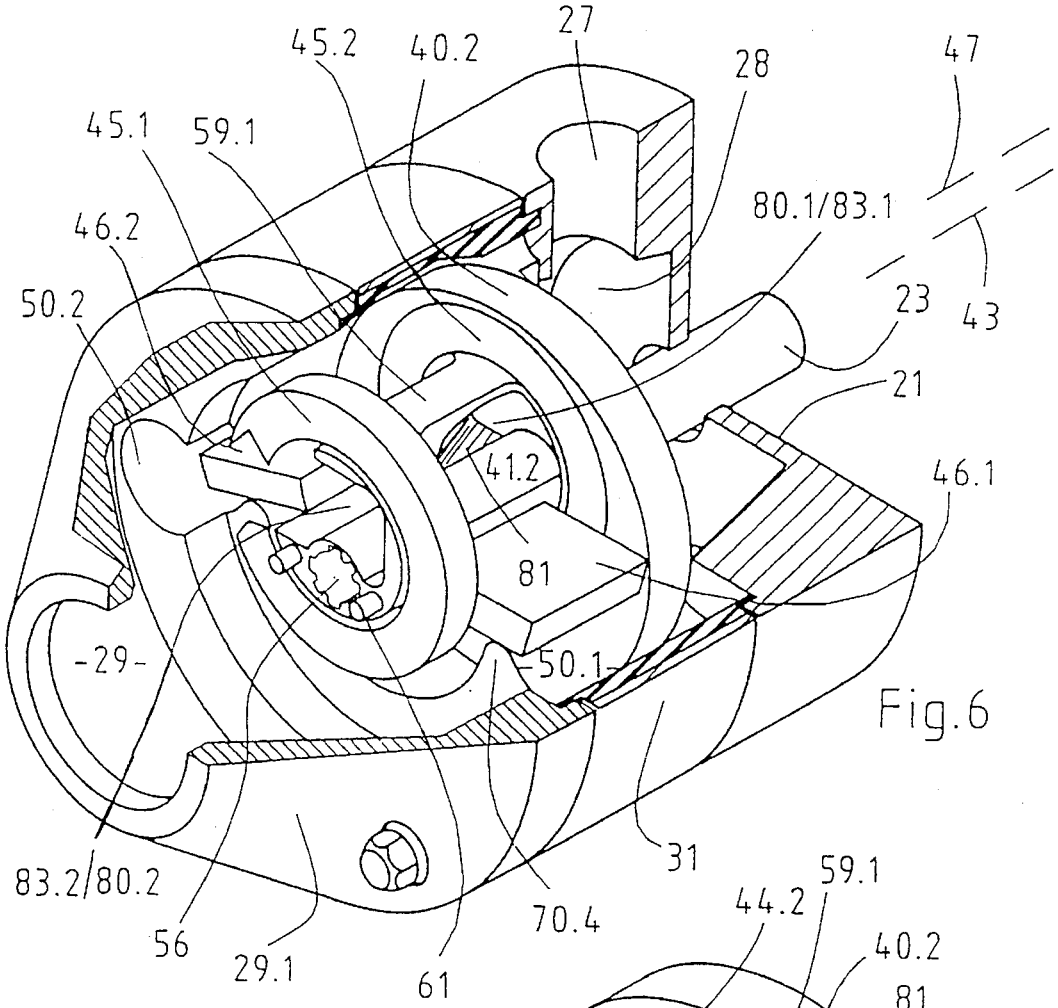
FIG. 6 shows a partially cut-away oblique view of the actual pump, in which the parts correspond to those of the preceding figures, but the illustration of the housing in relation to FIG. 1 is partially more simplified and schematic.

Moving on from the position in accordance with FIGS. 7.4, 8.4, passing the leading control edge 88.1 of the outlet opening 83.2 of the rotor outlet channel 80.2, the outlet side of the rotor comes over the upper edge 66.8 of the sliding vane 46.1, which is on the right in the drawings, in connection with the medium which has previously been trapped in the upper space region 98.1 of the pumping chamber 30. As the rotor continues its rotation, this part of the medium is forced to leave the rotor outlet channel 80.2 of the rotor and is expelled through the outlet opening 83.2 until the rotor has again reached the position illustrated in FIG. 7.1. Functioning is described in more detail below:

The path of the pumped medium can only be seen schematically in FIG. 1. The details of the path in the pump proper 20.1 cannot be seen in FIG. 1 and can best be seen in FIG. 6. However, in order to look at the path in detail, it is necessary to look at different drawings alternately, with the aid of which a description will be given below with reference thereto. The multiple views in FIG. 8 show successive phases of rotation corresponding to the views shown in FIG. 7, as the rotor is rotated anticlockwise.

The pumped medium in the inlet space 28 passes from the inlet space 28 through the inlet opening 83.1 into the rotor inlet channel 80.1 and is deflected therein helically by the oblique separating wall 81 and is guided outwards approximately radially through the lateral inlet opening 84.1 of the rotor inlet channel 80.1 into the pumping chamber 30, from the rotor 55 as the central region, depending on the position of the rotor 55 and the vanes 46.1 and 46.2. It is assumed in the description that the pump is full. Four different rotary position states of the rotor 55, with the two vanes 46.1 and 46.2 in the pumping chamber 30 and the adjoining vane receiving spaces 50.1 and 50.2, are shown in FIG. 7.

The regions of the pumping chamber 30 designated 97.1 and 97.2 are always at the pressure of the inlet space 28 and are thus in the light suction range, i.e. under a pressure which is lower than atmospheric pressure. The regions designated 98.1 and 98.2 are separated off from the inlet and from the outlet in the state of the pump illustrated and therefore enable a relaxation of the pumped medium, because they increase in size slightly in part regions during a short rotation distance until the pumping medium in the region 98.1 passes, as a result of the further movement of the rotor 55, with the rotor outlet channel 80.2, and the associated pivotal movement of the vanes 46.1 and 46.2, through the outlet opening 83.2 into liquid-conducting connection with the outlet and is now put under pressure downstream of the pumped medium which is located on the trailing side and is expelled by the trailing vane and reaches the outlet space 29, and thus the region of the outlet connection piece 29.1, by way of the rotor outlet channel 80.2 through the outlet opening 83.2, and thus leaves the pump under the desired pressure brought about by the pump, through the outlet line or other connected devices. The pumped medium also moves on this path in the radial direction out of the pumping chamber 30 through the pump chamber discharge opening 84.2 into the rotor outlet channel 80.2, is deflected therein in the axial direction on the oblique or helical separating wall 81 and leaves the actual pumping region in the direction of the outlet connection piece 29.1 through the outlet opening 83.2 and the outlet space 29.

The decimal digits used below show clearly which of the structurally different space parts are in each case at the same pressure level.

Figure 5:
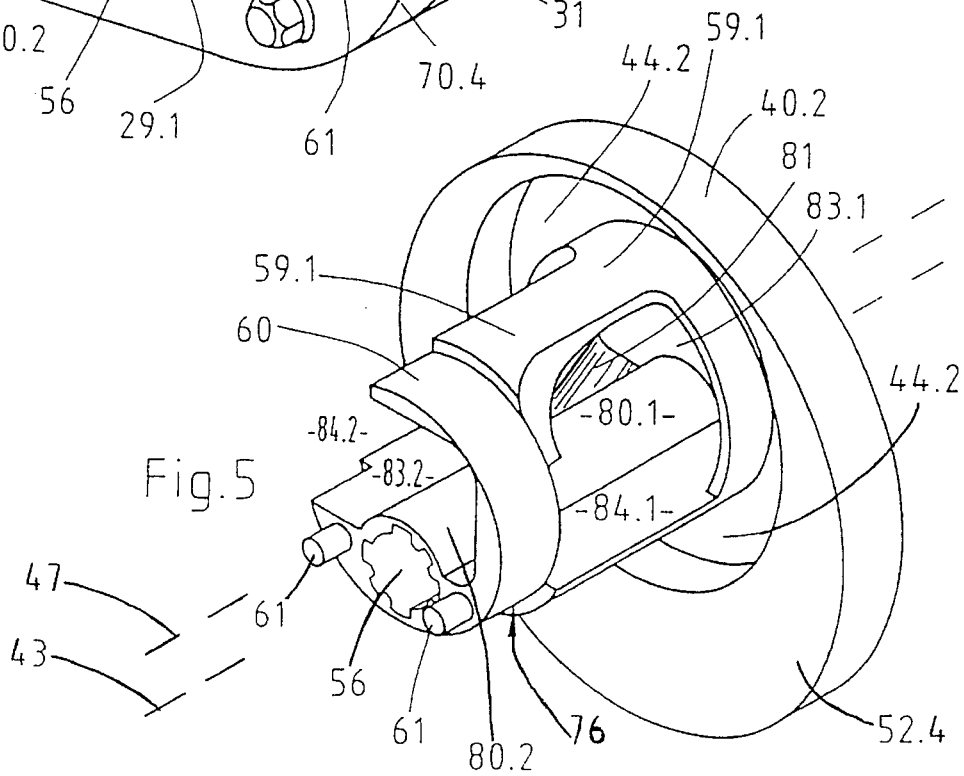
FIG. 5 shows an oblique view of the rotor, with the attached eccentric guide plate facing the inlet space, without any other add-on and mounting parts.

As is illustrated in FIGS. 7.1 to 7.4 and in particular also in FIG. 5, the rotor inlet channel 80.1 is the first space region which is at suction level and is consequently designated 97.1. In this rotary position, otherwise only the space region 97.2 in the small sickle-shaped intermediate region located on the right in FIG. 7.1 is at suction level in the pumping chamber 30, since as a result of the suction and the slight overpressure in the relaxation region 98 the vane 46.2—on the right in FIG. 7.1—is pressed against the bearing sealing surface 70.3 located at the top there and closes the space at this side. Moreover, the space is sealed off by the sealing region 76 of the rotor 55, which bears against the cylindrical pumping chamber wall 32, and with its outer guide plate sealing surfaces 52.1 and 52.3 at both ends, which are perpendicular to the pump axis 43, and by the two inwardly facing, planar guide plate sealing surfaces 52.2 and 52.4 of the eccentric guide plates 40.1 and 40.2. The planes perpendicular to the two axes 43 and 47, between the vanes 46.1 and 46.2 and the planar rectangular vane sealing surfaces 51.1, 51.2, 51.3, 51.4 sealing the guide plate sealing surfaces 52.2 and 52.4, are sliding sealing surfaces between components subjected to eccentric relative displacement movements.

The space 99.1 in the rotor outlet channel 80.2 is in liquid-conducting connection with the outlet space 29 in the outlet union 29.1 at pressure level. Moreover, the intermediate space 99.2—on the left in FIG. 7.1—is at the same pressure level as the vane receiving space 50.2, since as a result of the greatest pressure prevailing here the vane 46.2 is pressed against the bearing sealing surface 70.2, so that there is produced opposite it a small gap which produces the pressure connection to the vane receiving space 50.2. At the same time, in this rotary position the space 98.1 and, as a result of the position of the vane 46.1, the vane receiving space 50.1 are set to the relaxation pressure level.

When the rotor 55 rotates further, as is illustrated in FIG. 7.2, then the intermediate space 99.2 decreases in size and the rotor outlet channel 80.2 comes into liquid- and pressure-conducting connection with the space part 98.1 between the two vanes 46.1 and 46.2, so that this entire region, as a result of the displacement and overpressure effect which now takes place, results in the exiting of medium from the outlet connection piece 29.1. Here, the vanes 46.1 and 46.2 tip into the intermediate position illustrated in FIG. 7.2 and on further rotation into the position illustrated in FIG. 7.3, namely the straight position in which inlet and outlet are connected to equally sized part spaces in the pumping chamber region. On further rotation, the elements rotor 55, vanes 46.1 and 46.2 and the space portions adopt a distribution which is a mirror image of the arrangement according to FIG. 7.1, as FIG. 7.4 shows. The pressures and movements are adjusted accordingly. In accordance with the pressures, the vanes are also drawn by suction or pressed against the bearing sealing surfaces and the sealing is effected accordingly, and the vane receiving spaces are connected to the corresponding liquid and pressure regions in each case by slight tipping movements of the vanes. This is promoted by the advantageously resilient construction of the pump housing 31, since at least the surface and regions near to the surface are to be produced from a suitable elastomer, natural or synthetic rubber. These part housing regions or coatings are constructed in a metal, generally rust-free carrier housing part.

FIGS. 8.2 to 8.4 represent diagrammatic perspective illustrations of the pump discussed above. The digits following the point in the reference numerals in the Figures correspond to those of FIG. 7, so that the same angular positions of the rotor are designated by the same decimal digits. Moreover, the angular positions are added to the reference numerals in the Figures. An illustration corresponding to FIG. 7.1 is not shown. The illustrations contain some of the reference numerals as they have been used above, but primarily serve to illustrate the inlet and outlet openings of rotor inlet channel and rotor outlet channel. Only the edges of these two openings are additionally given reference numerals. From the positions shown in FIGS. 7.4 and 8.4, as rotation continues in accordance with the direction of rotation indicated by the arrow 85, the rotor 55 and the sliding vanes 46.1 and 46.2 first come by way of a position "235" (not shown) into a position "270" which is the mirror image of FIGS. 7.3 and 8.3 and a position "215" which is the mirror image of FIGS. 7.2 and 8.2, to the end of a revolution in accordance with FIG. 7.1.

The inlet opening 84.1 has delimitation edges 86.1 and 86.2 which run on the curved surface of the rotor 55 designated the outer wall 59, and has the leading control edge 87.1 and the trailing control edge 87.2, which are here drawn as axially parallel lines. To improve the transitional conditions in the corner regions they can also be rounded or profiled in another manner. In the illustration in FIGS. 8.2 the trailing control edge 88.2 of the pumping space outlet opening 84.2 is not visible. Consequently, its corner 88.21 is illustrated. Here, the leading control edge 88.1 is visible. In FIG. 8.4, only the trailing control edge 88.2 is visible, whereas instead of the leading control edge the corner 88.11 is illustrated.

The control edges 87.1 and 87.2, which run axially parallel, and 88.1 and 88.2 of the pumping inlet opening 84.1 and the pumping outlet opening 84.2 have a controlling function and behave like the control edges of sliding valve members in hydraulic valves or in two-stroke internal combustion engines.

From the outlet opening 83.2, there can be seen the edge delimitations 89.1 and 89.2, which are concentric to the outer wall 59 of the rotor 55, and the edge 89.3 opposite the separating wall and the delimitation line 89.4 around the drive opening 56. These are not all illustrated in all the Figures.

In the figures discussed below, variants for individual embodiment parts of the pump disclosed above are illustrated.

All the variants can respectively be usefully applied to the original pump by varying the corresponding components, or indeed they can be applied to pumps of different forms having different housings, different inlets, different drives, but the same basic principle of the construction of pump space, rotor, sliding vanes, pump wall openings and the like.

The variant embodiment in accordance with FIGS. 9.1 and 9.2 differs from those discussed above inasmuch as the sliding vanes 146.1 and 146.2 of a single pump are not now held on two sliding vane rings each lying by itself on either side of the pump housing. Rather, there is provided for the one sliding vane 146.1 a sliding vane ring 145.1 approximately of the size and relative arrangement as in the first embodiment. For the other sliding vane 146.2, however, there is provided a comparatively large sliding vane ring 145.2 which now lies on the same side of the pump housing as the sliding vane ring 145.1 of the sliding vane 146.1. As a result of its comparatively large internal diameter 144, the sliding vane ring 145.1 can be arranged within the sliding vane ring 145.2, as shown by FIG. 9.1, so that both sliding vanes 146.1 and 146.2 operate independently of one another and respectively in opposite directions as regards the direction of rotation. The corresponding annular grooves in the now only one eccentric guide plate are constructed in suitable dimensions and preferably with a separating collar between the two.

While FIG. 9.1 illustrates the two sliding vane rings 145.1 and 145.2 with their sliding vanes 146.1 and 146.2 secured thereto in outwardly projecting manner, individually and separated from one another, FIG. 9.2 shows how they lie relative to one another in the installed state.

As a result of this construction, assembly and disassembly can under some circumstances be carried out in a more favourable manner for certain pump constructions. In exchange, the symmetry of the components is lost to a small extent. However, this can be compensated by advantages in production and assembly.

The variant embodiment according to FIG. 10 differs from that above inasmuch as the sliding vanes 246.1 and 246.2 are secured at each of their sliding vane sealing surfaces 251.1 to 251.4 respectively to a sliding vane part ring 245.1 and 245.2 on the sliding vane 246.1 and to the sliding vane part rings 245.3 and 245.4 on the sliding vane 246.2. Thus, sliding vanes supported on either side can be arranged in annular grooves 244 in eccentric guide plates 240 in exactly the same way as in the first embodiment. As the partial assembly drawing in FIG. 10.3 shows, there is produced in each case between the ends 220.1 and 220.2 of the sliding vane part rings in the respective annular groove a part space 230 which is filled with medium and which grows larger and smaller during the pumping procedure in accordance with the oscillating procedure of the sliding vanes 246.1 and 246.2. However, this state of affairs brings about fewer disadvantages for most media than it brings advantages for the whole pump in supporting the sliding vanes 246 on either side and thus avoiding flexural loads on the sliding vanes and thus uneven wear on the sliding, sealing and bearing surfaces and being able to construct correspondingly thinner or more stable sliding vanes with their sliding vane rings and guides. Of the eccentric guide plates, only the one designated "240" and lying at the rear in the drawing is illustrated; the rest of the pump is omitted for the sake of clarity.

Figure 11:
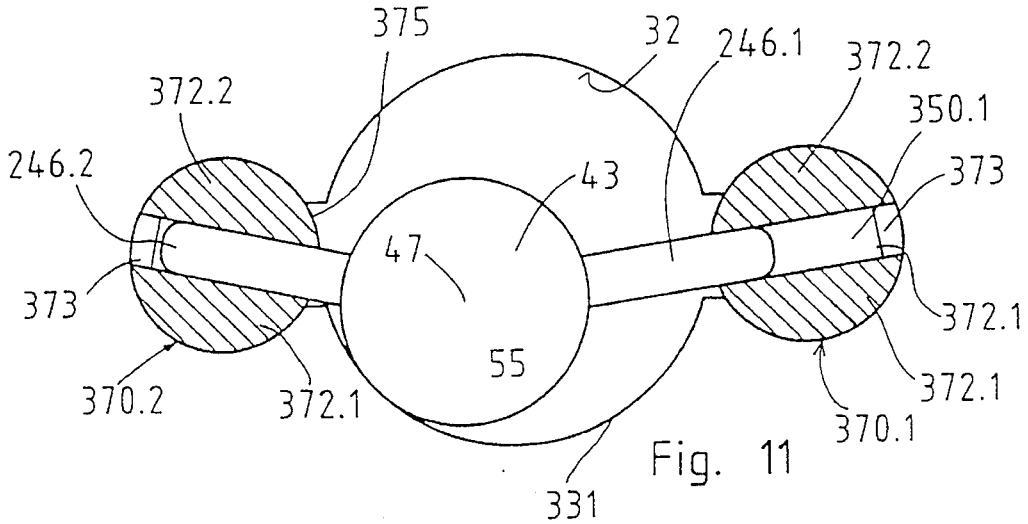
FIG. 11 is a diagrammatic sectional illustration through the pump parts of a further variant showing the pumping chamber, in which the rotor with its two sliding vanes is illustrated and sliding guide elements are illustrated in the slide receiving spaces, the sliding vanes being guided in the slots of the slide receiving spaces. Further pump parts have been omitted.
Figure 12:
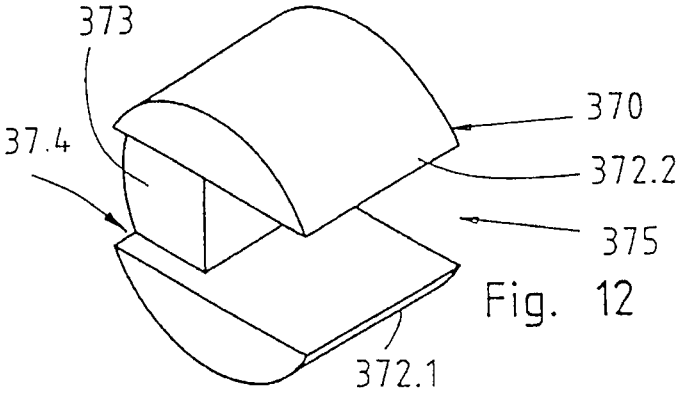
FIG. 12 is an oblique view of a single sliding-vane guide member.

FIGS. 11 and 12 show an embodiment in which the sliding vanes 246.1 and 246.2 are not guided freely between the bearing sealing surfaces 70 and as in the first embodiment, but rather sliding vane guide elements 370.1 and 370.2 are arranged in the sliding vane receiving spaces 350.1 and 350.2. The sliding vane guide elements are, as illustrated by FIG. 12, basically in the shape of cylindrical elements having an external diameter which corresponds to the internal diameter of the sliding vane receiving spaces 350.1 and 350.2. Otherwise, these cylindrical bodies have a diameter which is larger than the penetration depth of the ends of the sliding vanes 246.1 and 246.2. In the region lying beyond the sliding vane movement, a connection part 373 supporting the two cylinder sections 372.1 and 372.2 is provided in each case. Otherwise, relaxation channels are useful: on the left of FIG. 12 a relaxation channel 374 is indicated. There may also be some formed in the sliding surfaces. The sliding vanes slide in fitting manner in the slots 375.

The bearing sliding surfaces 70 of the first embodiment, having the inlet narrowed portions, are omitted in this variant. Their function is taken on by the sliding vane guide elements, with which sufficiently large inlet openings 375 of the sliding vane receiving spaces 350.1 and 350.2 are associated for the pivotal and inclined movements of the sliding vanes 346.1 and 346.2 respectively.

A pump construction of this type having sliding vane guide elements is primarily useful when the pump housing 331 and the sliding vanes 46.1 and 46.2 are also all of stainless chromium nickel steel and thus cannot run on one another in the long term without the interposition of lubricant materials. The components 370.1 and 370.2 comprise a suitable material which is neutral with respect to the medium to be pumped and which has good sliding properties, for example a synthetic material e.g. PEEK (polyether-ether-ketone) optionally incorporating carbon or graphite and/or other additives and/or components to improve sliding performance, possible in fibre form. Such material is designated "sliding bearing material" in the claims.

Figure 13:
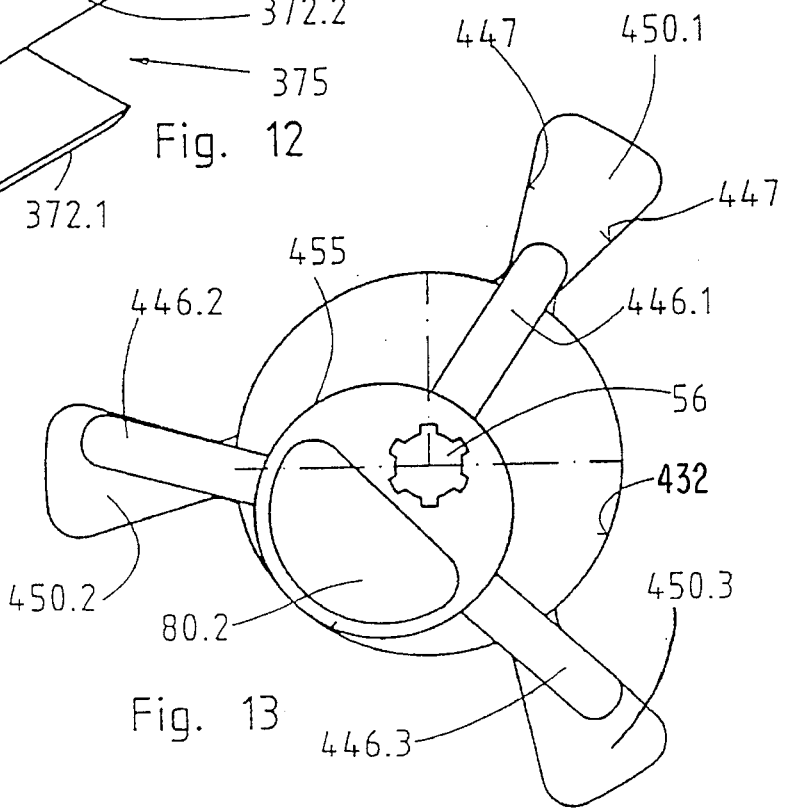
FIG. 13 is a schematic cross-sectional illustration of a further variation of a pump, with three sliding vanes and substantially triangular sliding-vane receiving spaces.

FIG. 13 shows a further variant. Here, for example, three sliding vanes 446.1, 446.2 and 446.3 are provided. The whole pump has to be shaped appropriately. A further particular feature here is the fact that the sliding vane receiving spaces 450.1, 450.2 and 450.3 are not cylindrical but are shaped to be approximately triangular in cross-section, in particular in accordance with the angles of pivoting of the sliding vanes 446.1 to 446.3. In this case, they are shaped such that the sliding vanes bear in the end positions of their pivotal movements against the substantially straight inner surfaces 447. Other shapes for the sliding vane receiving space, depending on the pump construction, the medium, any oscillation procedures and the like, can also be chosen. However, they must always ensure the free movement of the sliding vanes to the extent dependent on the amount of eccentricity. Housings having a pumping chamber wall 432, sliding vane openings and rotor 455 are shaped in accordance with the three sliding vanes 446.1 to 446.3.

Figure 14:
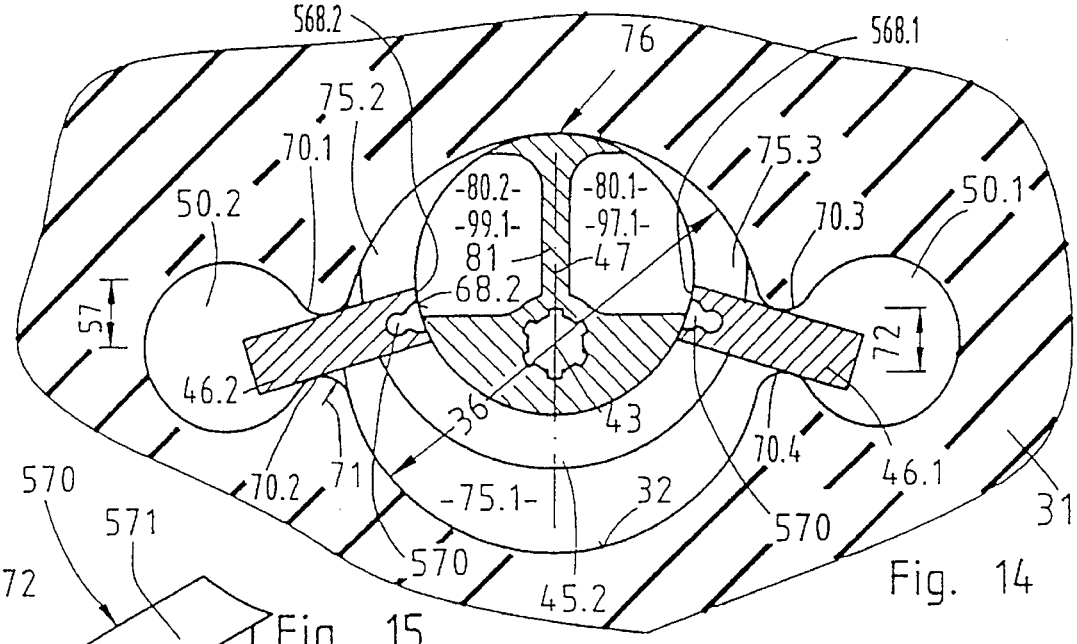
FIG. 14 is an illustration corresponding to FIG. 7.1 of a further variation of a pump, wherein sealing strips have been inserted into the sliding vanes.
Figure 15:
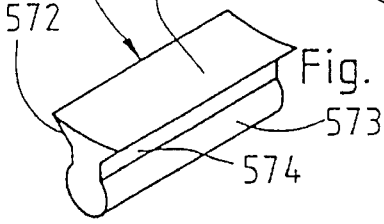
FIG. 15 is an oblique view of a single sealing strip.

The embodiment in accordance with FIGS. 14 and 15 shows how sealing strips 570 are inserted in the inner end sealing surfaces 568.1 and 568.2 of the sliding vanes 546.1 and 546.2. The sealing strips 570 are in this case by way of example formed in the actual sealing part by means of a slightly concave surface 571 which is in the shape of a part cylinder and which is constructed on a dovetail body part 572 which is inserted in close-fitting manner in a corresponding groove in the sliding vane 546.1 or 546.2 respectively. For this purpose, it has a holding bead 573 in the shape of a part cylinder and a parallel-walled transition part 574. Such sealing strips 570 are conveniently made of a resilient material which can have the same or similar material properties to the sliding vane guide elements discussed above and which, despite good or even improved sealing, prevents similar stainless steel materials from sliding directly on one another. In this connection, it should be noted that the sliding vanes only perform pivotal movements but at the end of their oscillation movement have to perform a turning movement, and the sealing strips 570 can also perform small tilting movements in relation to the support and as a result of the elasticity, and these tilting movements are to be accommodated by suitably constructed sealing strips and their materials.

Figure 16:
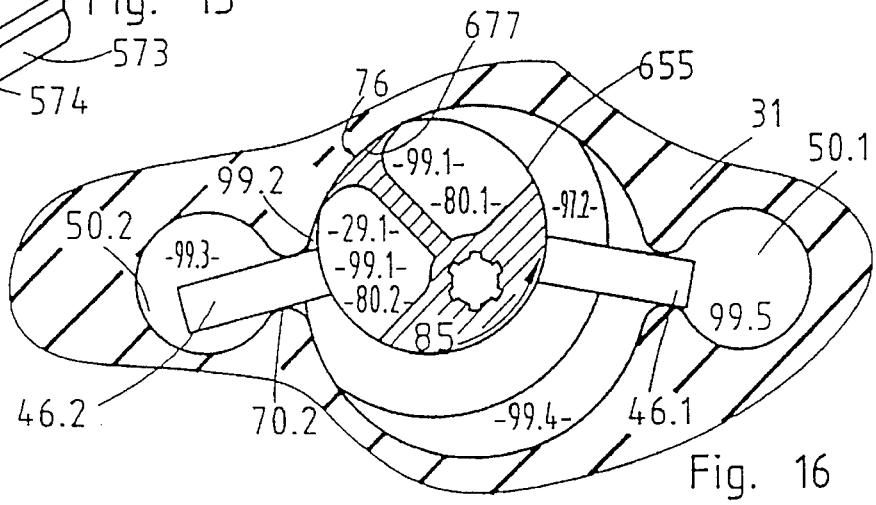
FIG. 16 is an illustration corresponding to FIG. 7.2, wherein, however, the rotor is not cylindrical overall, i.e. its cross section is not perfectly circular, but is shown, in the sealing region, with the radius of the pump-chamber wall, the usual free space prevailing in the sliding-vane receiving spaces.
Figure 17:
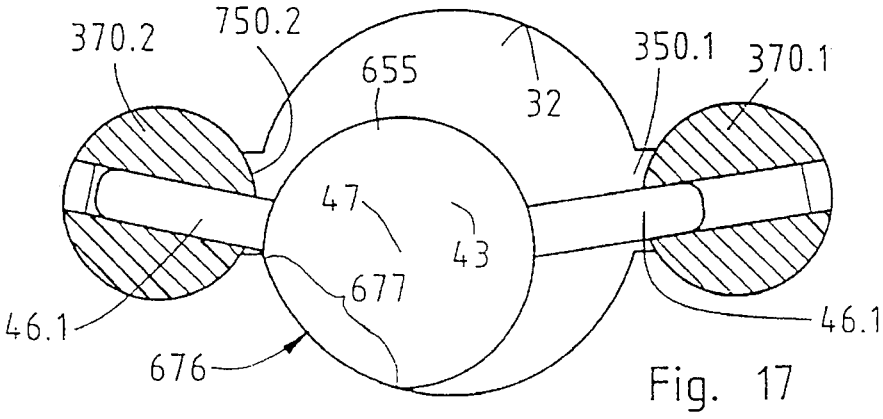
FIG. 17 is a highly schematic illustration of an arrangement for further explanation of the variation of the pump according to FIG. 16, wherein sliding-vane guide members are shown in the sliding-vane receiving spaces, and the rotor displays a sealing surface with the radius of the pump-chamber wall.

FIGS. 16 and 17 show that the sealing bearing 676 can if necessary be enlarged such that the rotor 655 is not given a precisely cylindrical shape as in the first embodiment and the variant embodiments discussed above, but in the region of the sealing bearing 676 is given a comparatively long sealing surface 677 which has exactly the same radius as the pumping chamber wall 32. FIGS. 15 and 16 differ in that the sliding vane receiving spaces 50.1 and 50.2 are shaped without any kind of fittings in the variant embodiment according to FIG. 15 and the sliding vanes 46.1 and 46.2 are supported on the bearing sealing surfaces 70 . . . , while in the variant embodiment in accordance with FIG. 17 sliding vane guide elements 370.1 and 370.2 are arranged in the sliding vane receiving spaces 350.1 and 350.2.

It is also possible to produce together with this variant other variant embodiments having more than two sliding vanes or differently shaped sliding vane receiving spaces, such as in accordance with FIG. 13, on a pump or other device.

Figure 18:
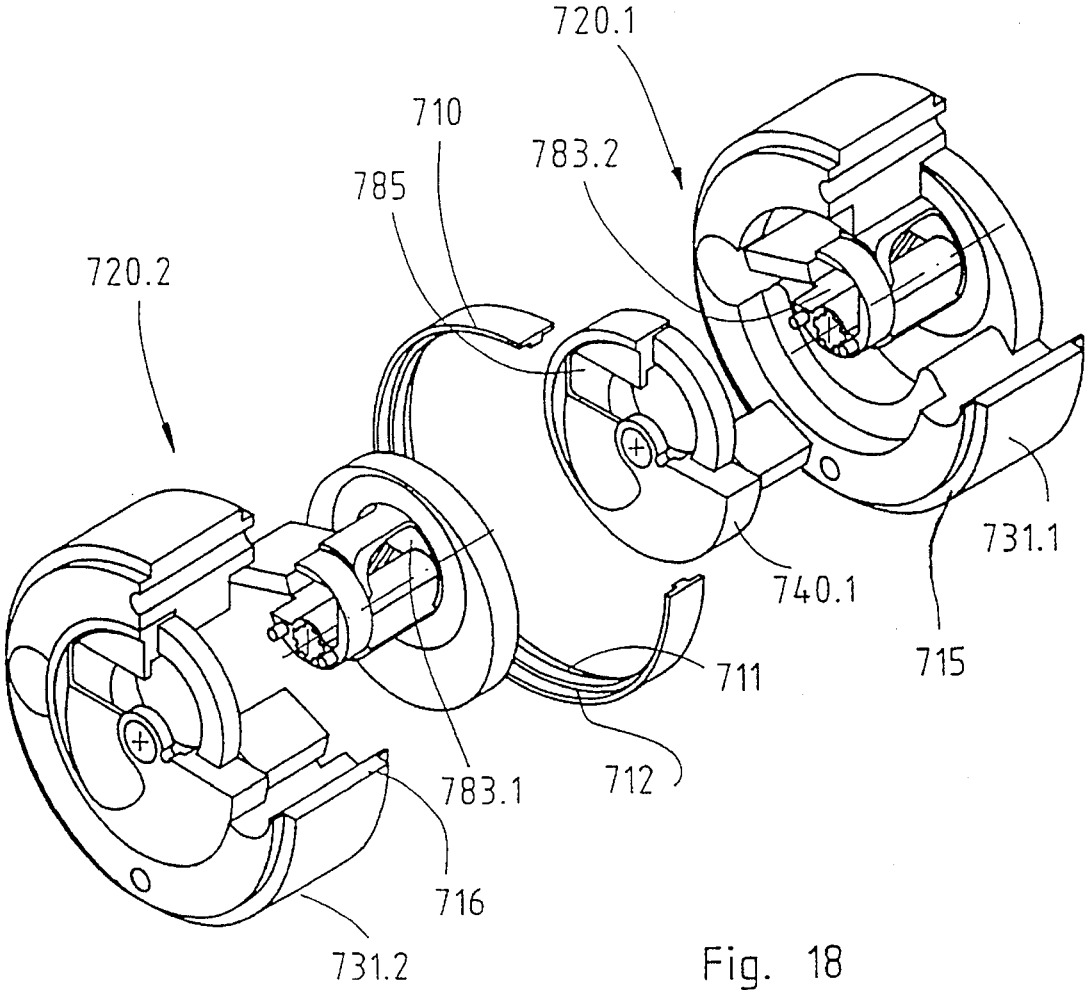
FIG. 18 is a schematic illustration of a further embodiment with the essential parts of two pumps, which, arranged one behind the other, can be driven on a common shaft, and which are to be assembled together using a connecting ring.

FIG. 18 shows a variant embodiment; the whole pump is not shown but only inner pump housings with their fittings. Here, it is provided that two completely identical pumps in accordance with the first embodiment are mounted on a single shaft and in this case there is arranged between the pumps only one connection ring 710 in the guide grooves 711 and 712 whereof the two shoulders 715 and 716 of the pump housings 731.1 and 731.2 are inserted for the purpose of flush alignment of the pump 720.1 on the right and the pump 720.2 on the left. Then, the liquid which is first compressed for example in the pump 720.1 on the right passes out of the outlet opening 783.2 through the passage opening 785 in the eccentric guide plate 740.1 on the right, directly through the corresponding passage opening in the eccentric guide plate 740.2 on the left and into the inlet opening 783.1 of the pump 720.2 on the left, so that the pump 720.1 on the right operates as a low-pressure pump and the pump 720.2 on the left operates as a high-pressure pump. As a result of this, the conveying level of a pump having small dimensions and favourable structural conditions can be improved quite considerably.

If two or more pumps are arranged offset at an angle to one another on one shaft and the conveying streams are brought together sensibly, then a larger conveying capacity and a conveying stream which is substantially less subject to fluctuation can be achieved, as can a larger and less turbulent conveying stream.

The invention can, in summary, also be described as follows:

The pump has in a bearing and sealing housing (21) an inlet space (28) and a drive shaft (23), which drives the rotor (55) and the two eccentric guide plates (40.2) connected thereto. Slide rings (45.1, 45.2) are mounted in the latter in annular grooves. These slide rings carry the vanes (46.1, 46.2) which penetrate into or are withdrawn from vane receiving spaces by way of bearing sealing surfaces. The pump is suitable for high hygienic requirements, as in the case of foodstuffs, medicines and cosmetics, and can also convey sensitive constituents, such as fruit or other foodstuff constituents, gently.

I claim:

1. A fluid conveying device comprising:

a housing having an inlet which is part of a suction side and an outlet which is part of a pressure side;

a cylindrical chamber with intake and discharge openings at opposite sides which respectively are in fluid communication with the suction side and the pressure side;

a rotor in the chamber, having a hollow rotor body mounted for eccentric rotation relative to an axis of the chamber, the rotor body having a longitudinal external surface forming a seal with a circumferential surface of the chamber, and a partition contiguous to the longitudinal external surface dividing the rotor body into an intake side, which has an axial intake opening at one end communicating with the intake opening of the chamber and has a radial opening for communication with the interior of the chamber, and a discharge side which has a radial opening for communicating with an interior of the chamber and an axial discharge opening, at the end opposite the intake opening, communicating with the discharge opening of the chamber;

a plurality of radially extending sealing vanes distributed about the rotor, each vane having an inner end in sealing relationship with a periphery of the rotor body and an outer end which extends through an associated sealing vane opening in a wall of the chamber and slides and rocks within a respective receiving space extending radially outward into the wall of the chamber from the sealing vane opening provided in the wall of the chamber which contains the vane therein;

a plurality of vane guides, a vane guide being coupled with each vane and being mounted to rotate eccentrically relative the axis in synchronism with the rotor as the rotor rotates, for producing the sliding and rocking of the sealing vanes as the rotor rotates;

an attachment for pivotally attaching the sealing vanes to rotor;

peripheral sealing regions of the chamber and of the sealing vanes providing a seal between the intake and discharge openings; and wherein the rotor rotates about the axis eccentrically with an exterior rotor surface running in contact with the circumferential surface of the chamber.

2. A device according to claim 1, wherein:

the rotor has opposed driven eccentric guide plates located at ends of the cylindrical chamber the eccentric guide plates having cylindrical ring-shaped guide grooves containing said vane guides comprising guide rings from which the sealing vanes project into the receiving space.

3. A device according to claim 1, wherein:

the sealing vanes are guided and supported at least in an inlet region of the sealing vane openings on one of curved sealing and support faces or in slots of rotatably movable sealing vane guide elements.

4. A device according to claim 3, wherein:

the sealing vane guide elements are cylindrical bodies of sliding bearing material having a diameter larger than a penetration depth of the ends of the sealing vanes and have in a region beyond sealing vane movement a supporting transverse connection.

5. A device according to claim 4, wherein:

the wall of the chamber, the rotor and the sealing vanes are formed from a corrosion-resistant material and the sealing vane guide elements are formed from a synthetic material having an agent promoting sliding.

6. A device according to claim 1, wherein:

the receiving spaces have a three-sided cross-section corresponding to an angle of pivoting of a respective sealing vane.

7. A device according to claim 1, wherein:

three sealing vanes are formed with associated receiving spaces and guiding and sealing elements.

8. A device according to claim 2, wherein:

the sealing vanes are flat plates, each plate having a curved inner end sealing surface which bears against a guide surface of a drive and guide body operating as the rotor and having a same radius as the sealing surface.

9. A device according to claim 1, wherein:

a sealing strip is disposed in an inner end sealing surface of each sealing vane pivoting on an outer wall of the rotor.

10. A device according to claim 9, further comprising:

a sealing groove containing the sealing strip and wherein the sealing strip is a plastic material.

11. A device according to claim 1, further comprising:

a rotor inlet channel and rotor outlet channel having an inlet opening and an outlet opening respectively facing in different directions and a pumping chamber inlet opening and a pumping chamber outlet opening which open towards an outer periphery of the rotor.

12. A device according to claim 1, wherein:

an external surface of the rotor deviates along a radius equal to a radius of the wall of the chamber.

13. A device according to claim 1, further comprising:

a perpendicular drive shaft extending through the inlet; and wherein the inlet has an annular cross section; and the outlet is below the perpendicular drive shaft.

14. A device according to claim 1, wherein:

transitions from the sealing vane openings comprise curved bearing surfaces having a spacing between opposed portions of the curved bearing surfaces larger than a thickness of one of the vanes facing the opposed portions.

15. A device according to claim 2 further comprising:

a pair of opposed guide plates attached respectively to ends of the rotor which rotate eccentrically with the rotor relative to the axis; and wherein the attachment for pivotally attaching the sealing vanes to the rotor comprises an annular groove disposed in a surface of each guide plate facing an interior of the chamber, and at least a partial ring is disposed in and is slidable relative to each guide plate with each at least partial ring having one of the vanes projecting from the ring into the receiving space.

16. A device in accordance with claim 2 wherein:

at least the circumferential surface of the wall of the chamber and the peripheral sealing regions are rubber.

17. A device in accordance with claim 1, further comprising:

guide plates which rotate eccentrically relative to the axis and with the plates having opposed end faces facing towards the chamber.

18. A device in accordance with claim 17, wherein:

the rotor carries the guide plates and vane sealing surfaces of the sealing vanes extending perpendicular to the axis are guided in a sliding sealing manner between the end faces.

19. A device according to claim 1, further comprising:

rings rotatably mounted relative to the axis and located outboard of opposed surfaces of the sealing vanes which opposed surfaces extend perpendicular to the pump axis.

20. A device according to claim 1, further comprising:

a pair of slide rings of different size are rotatably mounted relative to the axis and are located outboard of one of a pair of opposed surfaces of the sealing vanes which opposed surfaces extend perpendicular to the pump axis.

21. A fluid conveying device comprising:

a housing having an inlet which is part of a suction side and an outlet which is part of a pressure side;

a first cylindrical chamber with intake and discharge openings at opposite sides;

a first rotor in the first chamber, having a first hollow rotor body mounted for eccentric rotation relative to an axis of the first chamber, the first rotor body having a longitudinal external surface forming a seal with a circumferential surface of the first chamber, and a first partition contiguous to the longitudinal external surface dividing the first rotor body into an intake side, which has an axial intake opening at one end communicating with the intake opening of the first chamber and has a radial opening for communication with the interior of the first chamber, and a discharge side which has a radial opening for communicating with an interior of the first chamber and an axial discharge opening, at the end opposite the intake opening, communicating with the discharge opening of the first chamber;

a first plurality of radially extending sealing vanes distributed about the first rotor, each of the first plurality of vanes having an inner end in sealing relationship with a periphery of the first rotor body and an outer end which extends through an associated sealing vane opening in a wall of the first chamber and slides and rocks within a respective receiving space extending radially outward into the wall of the first from the sealing vane opening provided in the wall of the first chamber which contains the vane therein;

a first plurality of vane guides, each of the first plurality of vane guides being coupled with one vane of the first plurality of vanes and being mounted to rotate eccentrically relative the axis in synchronism with the first rotor as the first rotor rotates to produce the sliding and rocking of the first plurality of vanes as the first rotor rotates;

an attachment for pivotally attaching the first plurality of vanes to the first rotor;

peripheral sealing regions of the first chamber and of the first plurality of sealing vanes providing a seal between the intake and discharge openings; and wherein the first rotor rotates about the axis eccentrically with an exterior rotor surface running in contact with the circumferential surface of the first chamber;

a second cylindrical chamber axially aligned with the first chamber;

a second rotor in the second chamber, having a second hollow rotor body mounted for eccentric rotation relative to an axis of the first chamber, the second rotor body having a longitudinal external surface forming a seal with a circumferential surface of the second chamber, and a second partition contiguous to the longitudinal external surface dividing the second rotor body into an intake side, which has an axial intake opening at one end communicating with the intake opening of the second chamber and has a radial opening for communication with the interior of the second chamber, and a discharge side which has a radial opening for communicating with an interior of the second chamber and an axial discharge opening, at the end opposite the intake opening, communicating with the discharge opening of the second chamber;

a second plurality of radially extending sealing vanes distributed about the second rotor, each of the second plurality of vanes having an inner end in sealing relationship with a periphery of the second rotor body and an outer end which extends through an associated sliding vane opening in a wall of the second chamber and slides and rocks within a respective receiving space extending radially outward into the wall of the second chamber from the sealing vane opening provided in the wall of the second chamber which contains the vane therein;

a second plurality of vane guides, each of the second plurality of vane guides being coupled with one of the second plurality of vanes and being mounted to rotate eccentrically relative the axis in synchronism with the second rotor as the second rotor rotates to produce the sliding and rocking of the second plurality of vanes as the second rotor rotates;

an attachment for pivotally attaching the second plurality of vanes to the second rotor;

peripheral sealing regions of the second chamber and of the second plurality of sealing vanes providing a seal between the intake and discharge openings; and wherein the second rotor rotates about the axis eccentrically with an exterior rotor surface running in contact with the circumferential surface of the second chamber; and wherein the discharge side of the first rotor is in fluid communication with the intake side of the second rotor.

22. A device according to claim 21, wherein:

the first and second rotors each have opposed driven eccentric guide plates respectively rotating at ends of the first and second cylindrical chambers, the eccentric guide plates of each of the first and second rotors having cylindrical ring-shaped guide grooves containing said vane guides comprising guide rings from which the sealing vanes project into the receiving space.

23. A device according to claim 21, wherein:

the first and second plurality of vanes are guided and supported, at least in an inlet region of the sealing vane openings on one of curved sealing and support faces or in slots of rotatably movable sealing vane guide elements.

24. A device according to claim 23, wherein:

the sealing vane guide elements of the first and second rotors are cylindrical bodies of sliding bearing material having a diameter larger than a penetration depth of the ends of the sealing vanes and have in a region beyond sealing vane movement a supporting transverse connection.

25. A device according to claim 24, wherein:

the wall of the first and second chambers, the first and second rotors and the first and second plurality of sealing vanes are formed from a corrosion-resistant material and the sealing vane guide elements are formed from a synthetic material having an agent promoting sliding.

26. A device according to claim 21, wherein:

the receiving spaces of the first and second chambers have a three-sided cross-section in correspondence with an angle of pivoting of a respective sealing vane.

27. A device according to claim 22, wherein:

each rotor has three sealing vanes formed with associated receiving spaces and guiding and sealing elements.

28. A device according to claim 22, wherein:

the first and second plurality of vanes are flat plates, each plate having a curved inner end sealing surface which bears against a guide surface of a drive and guide body operating as the first and second rotor and having a same radius as the sealing surface.

29. A device according to claim 21, wherein:

a sealing strip is disposed in an inner end sealing surface of each sealing vane pivoting on an outer wall of one of the first and second rotors.

30. A device according to claim 29, further comprising:

a sealing groove containing each sealing strip and wherein the sealing strip is a plastic material.

31. A device according to claim 21, further comprising:

each rotor has a rotor inlet channel and rotor outlet channel having an inlet opening and an outlet opening respectively facing in different directions and a pumping chamber inlet opening and a pumping chamber outlet opening respectively which open towards an outer periphery of the rotor.

32. A device according to claim 21, wherein:

an external surface of the first and second rotors deviates along a radius equal to a radius of the first and second pumping chambers.

33. A device according to claim 21, wherein:

transitions from the sealing vane openings comprise curved bearing surfaces having a spacing between opposed portions of the curved bearing surfaces larger than a thickness of one of the vanes facing the opposed portions.

34. A device according to claim 21, further comprising:

a pair of opposed guide plates attached respectively to ends of the first and second rotors which rotate eccentrically respectively with the first and second rotors relative to the axis; and wherein the attachment for pivotally attaching the sealing vanes to the first and second rotors comprise an annular groove disposed in a surface of each guide plate facing an interior of its associated rotor; and at least a partial ring disposed in and slidable relative to each annular groove with each at least partial ring having one of the vanes projecting from the ring toward the interior of its rotor and is rotatable relative to the groove.

35. A device in accordance with claim 21 wherein:

at least the circumferential surface of the wall of the chambers and the peripheral sealing regions are rubber.

36. A device in accordance with claim 21 further comprising:

guide plates which rotate eccentrically relative to the axis and with the plates having opposed end faces facing towards the chambers.

37. A device in accordance with claim 36 wherein:

the rotors carry the guide plates and vane sealing surfaces of the sealing vanes extending perpendicular to the axis are guided in a sliding sealing manner between the end faces.

38. A device according to claim 21 further comprising:

rings rotatably mounted relative to the axis and located outboard of opposed surfaces of the sealing vanes which opposed surfaces extend perpendicular to the pump axis.

39. A device according to claim 21 further comprising:

a pair of slide rings of different size are rotatably mounted relative to the axis and are located outboard of one of a pair of opposed surfaces of the sealing vanes which opposed surfaces extend perpendicular to the pump axis.

* * * * *